US009626973B2

(12) United States Patent
Taleb et al.

(10) Patent No.: US 9,626,973 B2
(45) Date of Patent: Apr. 18, 2017

(54) ADAPTIVE BIT ALLOCATION FOR MULTI-CHANNEL AUDIO ENCODING

(75) Inventors: Anisse Taleb, Kista (SE); Stefan Andersson, Trångsund (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 2169 days.

(21) Appl. No.: 11/816,996

(22) PCT Filed: Dec. 22, 2005

(86) PCT No.: PCT/SE2005/002033

§ 371 (c)(1),
(2), (4) Date: Mar. 18, 2008

(87) PCT Pub. No.: WO2006/091139

PCT Pub. Date: Aug. 31, 2006

(65) Prior Publication Data

US 2008/0262850 A1 Oct. 23, 2008

Related U.S. Application Data

(60) Provisional application No. 60/654,956, filed on Feb. 23, 2005.

(51) Int. Cl.
*G10L 19/008* (2013.01)
*G10L 19/24* (2013.01)

(52) U.S. Cl.
CPC ..... *G10L 19/008* (2013.01); *G10L 19/24* (2013.01)

(58) Field of Classification Search
CPC ..... G10L 19/008; G10L 19/002; G10L 19/24; G10L 19/0204; G10L 19/08
See application file for complete search history.

(56) References Cited

U.S. PATENT DOCUMENTS

| | | | |
|---|---|---|---|
| 5,285,498 | A | 2/1994 | Johnston |
| 5,394,473 | A | 2/1995 | Davidson |
| 5,434,948 | A | 7/1995 | Holt et al. |
| 5,694,332 | A | 12/1997 | Maturi |

(Continued)

FOREIGN PATENT DOCUMENTS

| | | |
|---|---|---|
| EP | 0 497 413 A1 | 8/1992 |
| EP | 0 559 383 A1 | 9/1993 |

(Continued)

OTHER PUBLICATIONS

International Search Report for PCT/SE2005/002033, mailed Jun. 30, 2006.

(Continued)

*Primary Examiner* — Angela A Armstrong

(74) *Attorney, Agent, or Firm* — Nixon & Vanderhye P.C.

(57) ABSTRACT

The invention provides a highly efficient technique for encoding a multi-channel audio signal. The invention relies on the basic principle of encoding a first signal representation of one or more of the multiple channels in a first encoder and encoding a second signal representation of one or more of the multiple channels in a second, multi-stage, encoder. This procedure is significantly enhanced by providing a controller for adaptively allocating a number of encoding bits among the different encoding stages of the second, multi-stage, encoder in dependence on multi-channel audio signal characteristics.

43 Claims, 20 Drawing Sheets

(56) References Cited

U.S. PATENT DOCUMENTS

| | | | | |
|---|---|---|---|---|
| 5,812,971 | A | 9/1998 | Herre | |
| 5,956,674 | A | 9/1999 | Smyth et al. | |
| 5,974,380 | A * | 10/1999 | Smyth et al. | 704/229 |
| 6,012,031 | A | 1/2000 | Oliver et al. | |
| 6,341,165 | B1 | 1/2002 | Gbur et al. | |
| 6,446,037 | B1 | 9/2002 | Fielder et al. | |
| 6,487,535 | B1 | 11/2002 | Smyth et al. | |
| 6,591,241 | B1 | 7/2003 | Absar et al. | |
| 7,263,480 | B2 | 8/2007 | Minde et al. | |
| 7,340,391 | B2 | 3/2008 | Herre et al. | |
| 7,356,748 | B2 | 4/2008 | Taleb | |
| 7,437,299 | B2 | 10/2008 | Aarts et al. | |
| 7,447,629 | B2 * | 11/2008 | Breebaart | 704/219 |
| 7,725,324 | B2 | 5/2010 | Bruhn et al. | |
| 7,809,579 | B2 | 10/2010 | Bruhn et al. | |
| 7,822,617 | B2 | 10/2010 | Taleb et al. | |
| 2003/0061055 | A1 | 3/2003 | Taori et al. | |
| 2003/0115041 | A1 | 6/2003 | Chen et al. | |
| 2003/0115052 | A1 | 6/2003 | Chen et al. | |
| 2003/0231797 | A1 * | 12/2003 | Cullen et al. | 382/239 |
| 2004/0267543 | A1 | 12/2004 | Ojanpera | |
| 2005/0165611 | A1 | 7/2005 | Mehrotra et al. | |

FOREIGN PATENT DOCUMENTS

| | | | |
|---|---|---|---|
| EP | 0 965 123 | B1 | 12/1999 |
| EP | 1 391 880 | A2 | 2/2004 |
| JP | 11-032399 | | 2/1999 |
| JP | 2000-513888 | | 10/2000 |
| JP | 2001-184090 | | 7/2001 |
| JP | 2001-255892 | | 9/2001 |
| JP | 2001-255899 | | 9/2001 |
| JP | 2002-132295 | | 5/2002 |
| JP | 2002-169598 | | 6/2002 |
| JP | 2003-345398 | | 12/2003 |
| JP | 2004-509367 | | 3/2004 |
| JP | 2004-301954 | | 10/2004 |
| WO | WO 97/47102 | | 12/1997 |
| WO | 02/23528 | A1 | 3/2002 |
| WO | 03/090207 | A1 | 10/2003 |
| WO | WO 03/090206 | A1 | 10/2003 |
| WO | WO 03/090208 | A1 | 10/2003 |
| WO | WO 2005/001813 | A1 | 1/2005 |

OTHER PUBLICATIONS

Fuchs, "Improving Joint Stereo Audio Coding by Adaptive Inter-Channel Prediction," (1993) pp. 39-42.

Jean et al., "Two-Stage Bit Allocation Algorithm for Stereo Audio Coder," (1996) pp. 331-336.

Purnhagen, "Low Complexity Parametric Stereo Coding in MPEG-4," (2004) pp. 163-168.

Supplementary European Search Report mailed Apr. 19, 2010 in corresponding EP Application 05822014.6.

Chinese Office Action mailed Mar. 25, 2010 in corresponding Chinese Application 200580048503.5.

Linde, Y., et al., "An Algorithm for Vector Quantizer Design," IEEE Transactions on Communications, vol. Com-28, No. 1, Jan. 1980, pp. 84-95.

Golub et al, "Matrix Computations", second edition, chapter 4, pp. 137-138, The John Hopkins University Press, 1989.

English Translation of Japanese Office Action issued in Japanese Application No. 2007-216374, dated Oct. 30, 2010.

Japanese Office Action issued in Japanese Application Serial No. 2006-518596, dated May 7, 2008.

Summary of the Japanese Office Action in Japanese Application Serial No. 2006-518596, dated May 7, 2008.

3GPP Tech. Spec. TS 26.290, V6.1.0, 3rd Generation Partnership Project; Tech. Spec. Group Service and System Aspects; Audio Codec Processing Functions; Extended Adaptive Multi-Rate—Wideband (AMR-WB+) Codec; Transcoding Functions (Release 6), Dec. 2004.

B. Bdler and G. Schuller; Audio Coding Using a Psychoacoustic Pre- and Post-Filter; pp. 881-884. (2000).

D. Bauer and D. Seitzer; "Statistical Properties of High Quality Stereo Signals in the Time Domain;" pp. 2045-2048, (1989).

Shyh-Shiaw Kuo and James D. Johnston; "A Study of Why Cross Channel Prediction is Not Applicable to Perceptual Audio Coding;" IEEE Signal Processing Letters, vol. 8, No. 9, Sep. 2001; pp. 245-247.

4.1.2 Symmetry and the $LDL^T$ Factorization; Chapter 4 Special Linear Systems; pp. 137-138.

Herre, Jurgen; Brandenburg, Karlheinz; Lederer, D. Intensity Stereo Coding. AES Convention:96 (Feb. 1994) Paper No. 3799 Affiliation: Fraunhofer Gesellschaft, Institut fur Integrierte Schaltungen, Erlangen, Germany.

Bosi, Marina; Brandenburg, Karlheinz; Quackenbush, Schuyler; Fielder, Louis; Akagiri, Kenzo; Hendrik; Dietz, Martin. ISO/IEC MPEG-2 Advanced Audio Coding. JAES vol. 45 Issue 10 pp. 789-814; Oct. 1997.

Baumgarte, Frank; Faller, Christof. Why Binaural Cue Coding is Better than Intensity Stereo Coding. Media Signal Processing Research, Agere Systems, Murray Hill, NJ. AES Convention: 112 (Apr. 2002) Paper No. 5575.

Yang, Dai; Ai, Hongmei; Kyriakakis, Chris; Kuo, C.-C. Jay. An Inter-Channel Redundancy Removal Approach for High-Quality Multichannel Audio Compression. Affiliation: Integrated Media Systems Center, University of Southern California, Los Angeles, CA. AES Convention: 109 (Sep. 2000) Paper No. 5238.

Oomen, W. et al.; Advances in Parametric Coding for High-Quality Audio. Philips Digital Systems Laboratories, Eindhoven, The Netherlands; Philips Research Laboratories, Eindhoven, The Netherlands, AES Convention: 114 (Mar. 2003).

Canadian Office Action issued in Canadian Application No. 2,527,971, dated Jun. 17, 2008.

International Search Report and Written Opinion issued in PCT Application No. PCT/SE2004/001907, dated Mar. 17, 2005.

L.R. Rabiner and R.W. Schafer. Digital Processing of Speech Signals. Upper Saddle River, New Jersey: Prentice Hall, Inc., 1978. pp. 116-130.

International Search Report and Written Opinion issued in PCT Application No. PCT/SE2004/001867 dated Mar. 17, 2005.

International Search Report issued in PCT Application No. PCT/SE2006/000235 dated Jun. 30, 2006.

Christof Faller and Frank Baumgarte; "Efficient Representation of Spatial Audio Using Perceptual Parametrization;" Applications of Signal Processing to Audio and Acoustics; 2001 IEEE Workshop on Publication date Oct. 21-24, 2001; pp. W2001-1 through W2001-4.

European Office Action issued in European Application No. 04 809 080.7 dated Feb. 22, 2010.

European Search Report issued in European Application No. 06 716 925.0 dated Jun. 29, 2010.

Juang, B.H., et al., "Multiple Stage Vector Quantization for Speech Coding," Signal Technology Inc., 15 W. De La Guerra, Santa Barbara, CA 93101, pp. 597-600.

Faller et al., "Binaural cue coding applied to stereo and multi-channel audio compression", 112.sup.th AES convention, May 2002, Munich, Germany.

Faller et al, "Binaural cue coding—Part I: Psychoacoustic fundamentals and design principles", IEEE Trans. Speech Audio Processing, vol. 11, pp. 509-519, Nov. 2003.

Stuart, "The psychoacoustics of multichannel audio", Meridian Audio Ltd, Jun. 1998.

Edler, C. Faller and G. Schuller, "Perceptual audio coding using a time-varying linear pre- and post-filter", in AES Convention, Los Angeles, Calif., Sep. 2000.

Japanese Office Action mailed Jun. 3, 2011 in corresponding JP application 2007-552087.

* cited by examiner

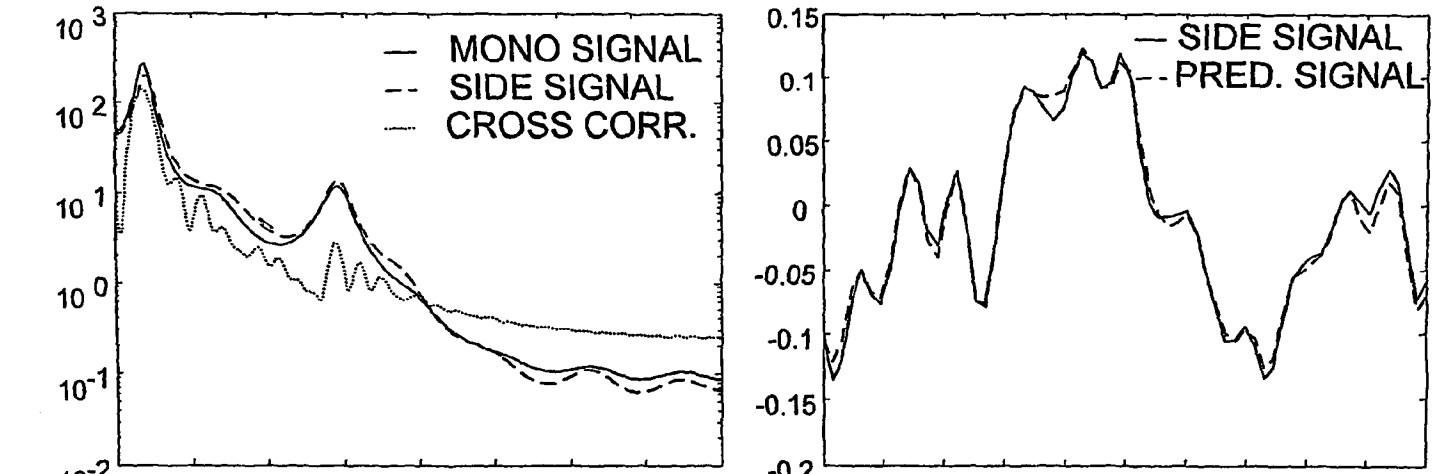
*Fig. 11A*
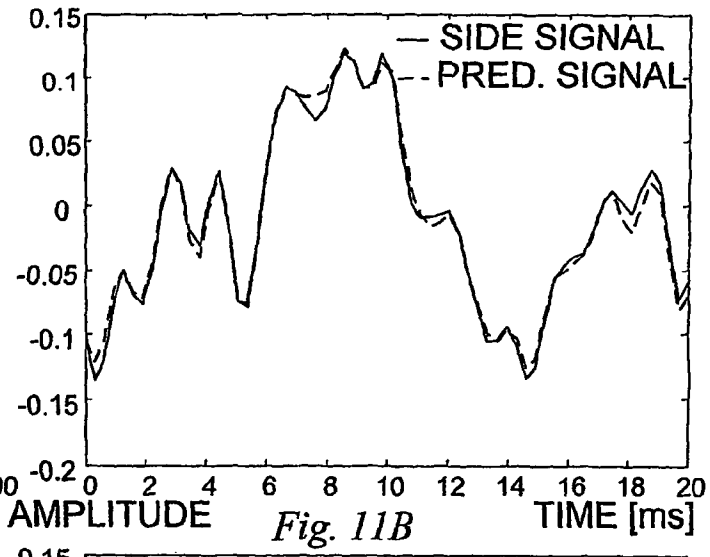
*Fig. 11B*
*Fig. 11C*
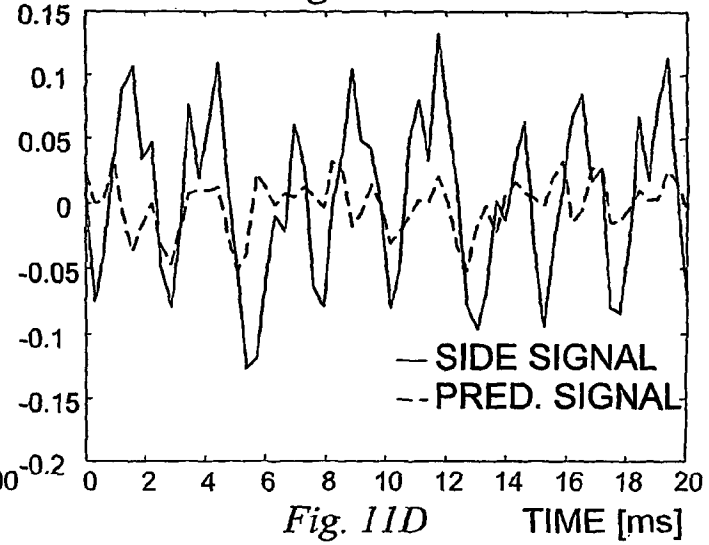
*Fig. 11D*

ADAPTIVE BIT ALLOCATION FOR MULTI-CHANNEL AUDIO ENCODING

This application is the U.S. national phase of International Application No. PCT/SE2005/002033, filed 22 Dec. 2005, which designated the U.S. and claims priority to U.S. Provisional Application No. 60/654,956, filed 23 Feb. 2005, the entire contents of each of which are hereby incorporated by reference.

TECHNICAL FIELD

The technology disclosed herein generally relates to audio encoding and decoding techniques, and more particularly to multi-channel audio encoding such as stereo coding.

BACKGROUND

There is a high market need to transmit and store audio signals at low bit rates while maintaining high audio quality. Particularly, in cases where transmission resources or storage is limited low bit rate operation is an essential cost factor. This is typically the case, for example, in streaming and messaging applications in mobile communication systems such as GSM, UMTS, or CDMA.

A general example of an audio transmission system using multi-channel coding and decoding is schematically illustrated in FIG. 1. The overall system basically comprises a multi-channel audio encoder 100 and a transmission module 10 on the transmitting side, and a receiving module 20 and a multi-channel audio decoder 200 on the receiving side.

The simplest way of stereophonic or multi-channel coding of audio signals is to encode the signals of the different channels separately as individual and independent signals, as illustrated in FIG. 2. However, this means that the redundancy among the plurality of channels is not removed, and that the bit-rate requirement will be proportional to the number of channels.

Another basic way used in stereo FM radio transmission and which ensures compatibility with legacy mono radio receivers is to transmit a sum and a difference signal of the two involved channels.

State-of-the art audio codecs such as MPEG-1/2 Layer III and MPEG-2/4 AAC make use of so-called joint stereo coding. According to this technique, the signals of the different channels are processed jointly rather than separately and individually. The two most commonly used joint stereo coding techniques are known as 'Mid/Side' (M/S) Stereo and intensity stereo coding which usually are applied on sub-bands of the stereo or multi-channel signals to be encoded.

M/S stereo coding is similar to the described procedure in stereo FM radio, in a sense that it encodes and transmits the sum and difference signals of the channel sub-bands and thereby exploits redundancy between the channel sub-bands. The structure and operation of a coder based on M/S stereo coding is described, e.g. in reference [1].

Intensity stereo on the other hand is able to make use of stereo irrelevancy. It transmits the joint intensity of the channels (of the different sub-bands) along with some location information indicating how the intensity is distributed among the channels. Intensity stereo does only provide spectral magnitude information of the channels, while phase information is not conveyed. For this reason and since temporal inter-channel information (more specifically the inter-channel time difference) is of major psycho-acoustical relevancy particularly at lower frequencies, intensity stereo can only be used at high frequencies above e.g. 2 kHz. An intensity stereo coding method is described, e.g. in reference [2].

A recently developed stereo coding method called Binaural Cue Coding (BCC) is described in reference [3]. This method is a parametric multi-channel audio coding method. The basic principle of this kind of parametric coding technique is that at the encoding side the input signals from N channels are combined to one mono signal. The mono signal is audio encoded using any conventional monophonic audio codec. In parallel, parameters are derived from the channel signals, which describe the multi-channel image. The parameters are encoded and transmitted to the decoder, along with the audio bit stream. The decoder first decodes the mono signal and then regenerates the channel signals based on the parametric description of the multi-channel image.

The principle of the Binaural Cue Coding (BCC) method is that it transmits the encoded mono signal and so-called BCC parameters. The BCC parameters comprise coded inter-channel level differences and inter-channel time differences for sub-bands of the original multi-channel input signal. The decoder regenerates the different channel signals by applying sub-band-wise level and phase and/or delay adjustments of the mono signal based on the BCC parameters. The advantage over e.g. M/S or intensity stereo is that stereo information comprising temporal inter-channel information is transmitted at much lower bit rates. However, BCC is computationally demanding and generally not perceptually optimized.

Another technique, described in reference [4] uses the same principle of encoding of the mono signal and so-called side information. In this case, the side information consists of predictor filters and optionally a residual signal. The predictor filters, estimated by an LMS algorithm, when applied to the mono signal allow the prediction of the multi-channel audio signals. With this technique one is able to reach very low bit rate encoding of multi-channel audio sources, however at the expense of a quality drop.

The basic principles of such parametric stereo coding are illustrated in FIG. 3, which displays a layout of a stereo codec, comprising a down-mixing module 120, a core mono codec 130, 230 and a parametric stereo side information encoder/decoder 140, 240. The down-mixing transforms the multi-channel (in this case stereo) signal into a mono signal. The objective of the parametric stereo codec is to reproduce a stereo signal at the decoder given the reconstructed mono signal and additional stereo parameters.

Finally, for completeness, a technique is to be mentioned that is used in 3D audio. This technique synthesizes the right and left channel signals by filtering sound source signals with so-called head-related filters. However, this technique requires the different sound source signals to be separated and can thus not generally be applied for stereo or multi-channel coding.

SUMMARY

The technology disclosed herein overcomes these and other drawbacks of the prior art arrangements.

It is a general object of the technology disclosed herein to provide high multi-channel audio quality at low bit rates.

In particular it is desirable to provide an efficient encoding process that is capable of accurately representing stereophonic or multi-channel information using a relatively low number of encoding bits. For stereo coding, for example, it is important that the dynamics of the stereo image are well represented so that the quality of stereo signal reconstruction is enhanced.

It is also an object of the technology disclosed herein to make efficient use of the available bit budget for a multi-stage side signal encoder.

It is a particular object of the technology disclosed herein to provide a method and apparatus for encoding a multi-channel audio signal.

Another particular object of the technology disclosed herein is to provide a method and apparatus for decoding an encoded multi-channel audio signal.

Yet another object of the technology disclosed herein is to provide an improved audio transmission system based on audio encoding and decoding techniques.

Today, there are no standardized codecs available providing high stereophonic or multi-channel audio quality at bit rates which are economically interesting for use in e.g. mobile communication systems. What is possible with available codecs is monophonic transmission and/or storage of the audio signals. To some extent also stereophonic transmission or storage is available, but bit rate limitations usually require limiting the stereo representation quite drastically.

The technology disclosed herein overcomes these problems by proposing a solution, which allows to separate stereophonic or multi-channel information from the audio signal and to accurately represent it with a low bit rate.

A basic idea of the technology disclosed herein is to provide a highly efficient technique for encoding a multi-channel audio signal. The technology disclosed herein relies on the basic principle of encoding a first signal representation of one or more of the multiple channels in a first signal encoding process and encoding a second signal representation of one or more of the multiple channels in a second, multi-stage, signal encoding process. This procedure is significantly enhanced by adaptively allocating a number of encoding bits among the different encoding stages of the second, multi-stage, signal encoding process in dependence on multi-channel audio signal characteristics.

For example, if the performance of one of the stages in the multi-stage encoding process is saturating, there is no use to increase the number of bits allocated for encoding/quantization at this particular encoding stage. Instead it may be better to allocate more bits to another encoding stage in the multi-stage encoding process so as to provide a greater overall improvement in performance. For this reason it has turned out to be particularly beneficial to perform bit allocation based on estimated performance of at least one encoding stage. The allocation of bits to a particular encoding stage may for example be based on estimated performance of that encoding stage. Alternatively, however, the encoding bits are jointly allocated among the different encoding stages based on the overall performance of a combination of encoding stages.

For example, the first encoding process may be a main encoding process and the first signal representation may be a main signal representation. The second encoding process, which is a multi-stage process, may for example be a side signal process, and the second signal representation may then be a side signal representation such as a stereo side signal.

Preferably, the bit budget available for the second, multi-stage, signal encoding process is adaptively allocated among the different encoding stages based on inter-channel correlation characteristics of the multi-channel audio signal. This is particularly useful when the second multi-stage signal encoding process includes a parametric encoding stage such as an inter-channel prediction (ICP) stage. In the event of low inter-channel correlation, the parametric (ICP) filter, as a means for multi-channel or stereo coding, will normally produce a relatively poor estimate of the target signal. Therefore, increasing the number of allocated bits for filter quantization does not lead to significantly better performance. The effect of saturation of performance of the ICP filter and in general of parametric coding makes these techniques quite inefficient in terms of bit usage. In fact, the bits could be used for different encoding in another encoding stage, such as e.g. non-parametric coding, which in turn could result in greater overall improvement in performance.

In a particular embodiment, the technology disclosed herein involves a hybrid parametric and non-parametric encoding process and overcomes the problem of parametric quality saturation by exploiting the strengths of (inter-channel prediction) parametric representations and non-parametric representations based on efficient allocation of available encoding bits among the parametric and non-parametric encoding stages.

Preferably, the procedure of allocating bits to a particular encoding stage is based on assessment of estimated performance of the encoding stage as a function of the number of bits to be allocated to the encoding stage.

In general, the bit-allocation can also be made dependent on performance of an additional stage or the overall performance of two or more stages. For example, the bit allocation can be based on the overall performance of the combination of both parametric and non-parametric representations.

For example, consider the case of a first adaptive inter-channel prediction (ICP) stage for second-signal prediction. The estimated performance of the ICP encoding stage is normally based on determining a relevant quality measure. Such a quality measure could for example be estimated based on the so-called second-signal prediction error, preferably together with an estimation of a quantization error as a function of the number of bits allocated for quantization of second signal reconstruction data generated by the inter-channel prediction. The second signal reconstruction data is typically the inter-channel prediction (ICP) filter coefficients.

In a particularly advantageous embodiment, the second, multi-stage, signal encoding process further comprises an encoding process in a second encoding stage for encoding a representation of the signal prediction error from the first stage.

The second signal encoding process normally generates output data representative of the bit allocation, as this will be needed on the decoding side to correctly interpret the encoded/quantized information in the form of second signal reconstruction data. On the decoding side, a decoder receives bit allocation information representative of how the bit budget has been allocated among the different signal encoding stages during the second signal encoding process. This bit allocation information is used for interpreting the second signal reconstruction data in a corresponding second, multi-stage, signal decoding process for the purpose of correctly decoding the second signal representation.

For further improvement of the multi-channel audio encoding mechanism, it is also possible to use an efficient variable dimension/variable-rate bit allocation based on the performance of the second encoding process or at least one of the encoding stages thereof. In practice, this normally means that a combination of number of bits to be allocated to the first encoding stage and filter dimension/length is selected so as to optimize a measure representative of the performance of the first stage or a combination of stages. The use of longer filters lead to better performance, but the quantization of a longer filter yields a larger quantization error if the bit-rate is fixed. With increased filter length, comes the possibility of increased performance, but to reach it more bits are needed. There will be a trade-off between selected filter dimension/length and the imposed quantization error, and the idea is to use a performance measure and find an optimum value by varying the filter length and the required amount of bits accordingly.

Although bit allocation and encoding/decoding is often performed on a frame-by-frame basis, it is possible to perform bit allocation and encoding/decoding on variable sized frames, allowing signal adaptive optimized frame processing.

In particular, variable filter dimension and bit-rate can be used on fixed frames but also on variable frame lengths.

For variable frame lengths, an encoding frame can generally be divided into a number of sub-frames according to various frame division configurations. The sub-frames may have different sizes, but the sum of the lengths of the sub-frames of any given frame division configuration is equal to the length of the overall encoding frame. In a preferred exemplary embodiment of the technology disclosed herein, the idea is to select a combination of frame division configuration, as well as bit allocation and filter length/dimension for each sub-frame, so as to optimize a measure representative of the performance of the considered second encoding process (i.e. at least one of the signal encoding stages thereof) over an entire encoding frame. The second signal representation is then encoded separately for each of the sub-frames of the selected frame division configuration in accordance with the selected combination of bit allocation and filter dimension. In addition to the general high-quality, low bit-rate performance offered by the signal adaptive bit allocation of the technology disclosed herein, a significant advantage of the variable frame length processing scheme is that the dynamics of the stereo or multi-channel image is very well represented.

The second signal encoding process here preferably generates output data, for transfer to the decoding side, representative of the selected frame division configuration, and for each sub-frame of the selected frame division configuration, bit allocation and filter length. However, to reduce the bit-rate requirements on signaling from the encoding side to the decoding side in an audio transmission system, the filter length, for each sub frame, is preferably selected in dependence on the length of the sub-frame. This means that an indication of frame division configuration of an encoding frame into a set of sub-frames at the same time provides an indication of selected filter dimension for each sub-frame, thereby reducing the required signaling.

The technology disclosed herein offers the following advantages:

- Improved multi-channel audio encoding/decoding.
- Improved audio transmission system.
- Increased multi-channel audio reconstruction quality.
- High multi-channel audio quality at relatively low bit rates.
- Efficient use of the available bit budget for a multi-stage encoder such as a multi-stage side signal encoder.
- Good representation of the dynamics of the stereo image
- Enhanced quality of stereo signal reconstruction.

Other advantages offered by the technology disclosed herein will be appreciated when reading the below description of embodiments of the technology disclosed herein.

BRIEF DESCRIPTION OF THE DRAWINGS

The technology disclosed herein , together with further objects and advantages thereof, will be best understood by reference to the following description taken together with the accompanying drawings, in which:

FIG. 11A is a frequency-domain diagram illustrating a mono signal and a side signal and the inter-channel correlation, or cross-correlation, between the mono and side signals.

FIG. 11B is a time-domain diagram illustrating the predicted side signal along with the original side signal corresponding to the case of FIG. 11A.

FIG. 11C is frequency-domain diagram illustrating another mono signal and side signal and their cross-correlation.

FIG. 11D is a time-domain diagram illustrating the predicted side signal along with the original side signal corresponding to the case of FIG. 11C.

DETAILED DESCRIPTION OF EMBODIMENTS OF THE INVENTION

Figure 1:
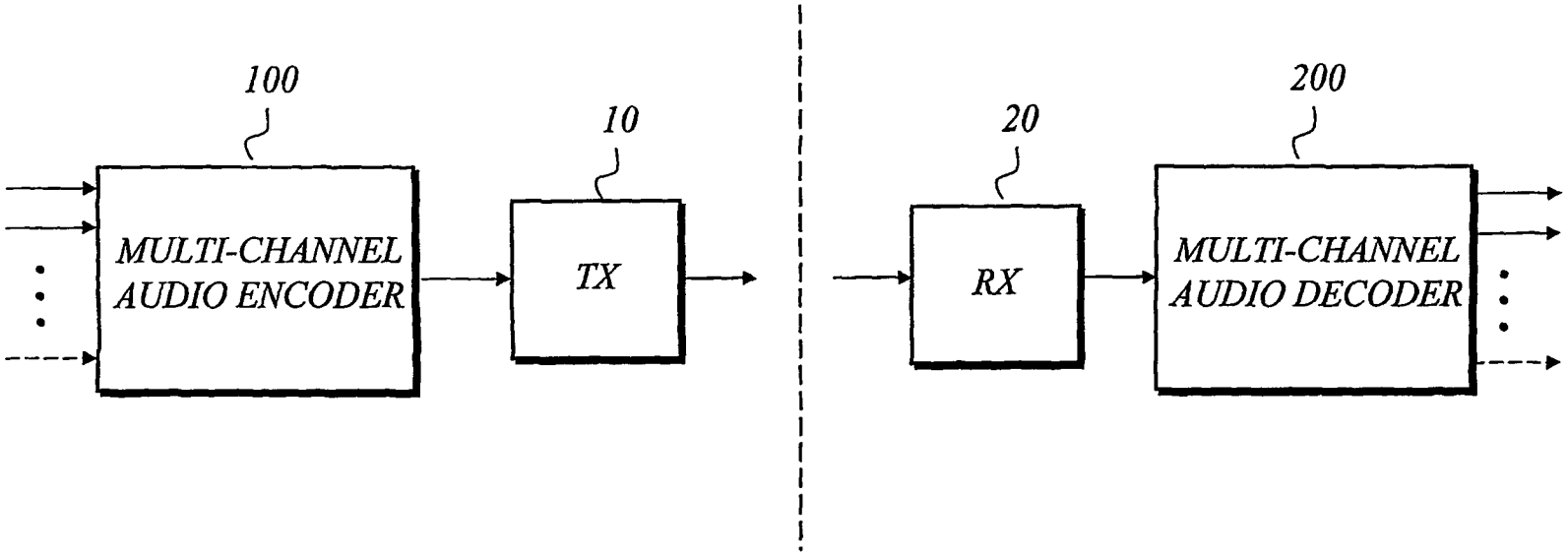
Fig. 1 (Prior art)
FIG. 1 is a schematic block diagram illustrating a general example of an audio transmission system using multi-channel coding and decoding.
Figure 2:
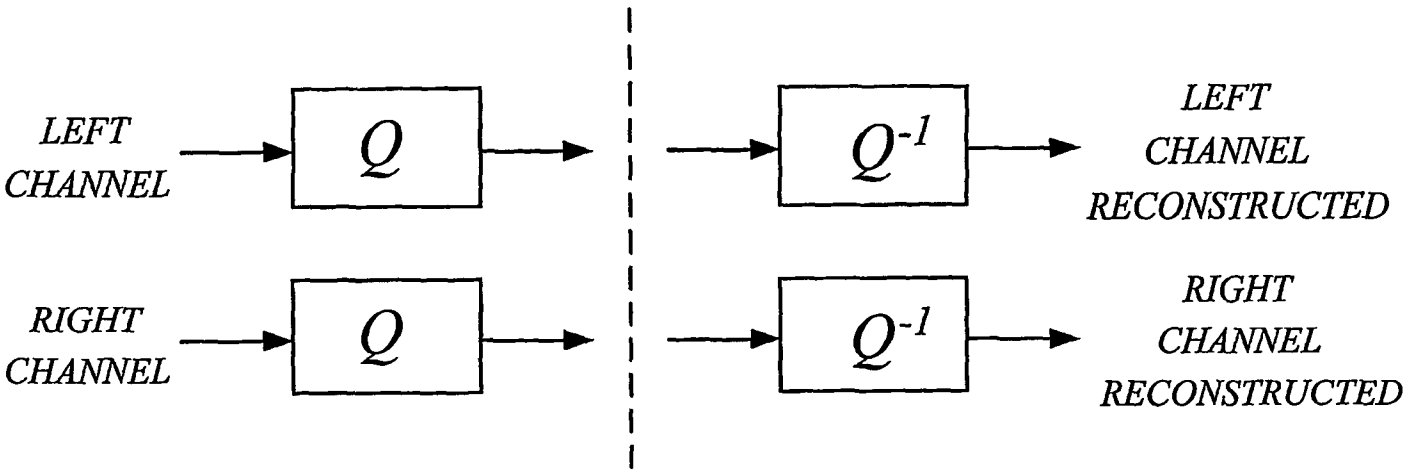
Fig. 2 (Prior art)
FIG. 2 is a schematic diagram illustrating how signals of different channels are encoded separately as individual and independent signals.
Figure 3:
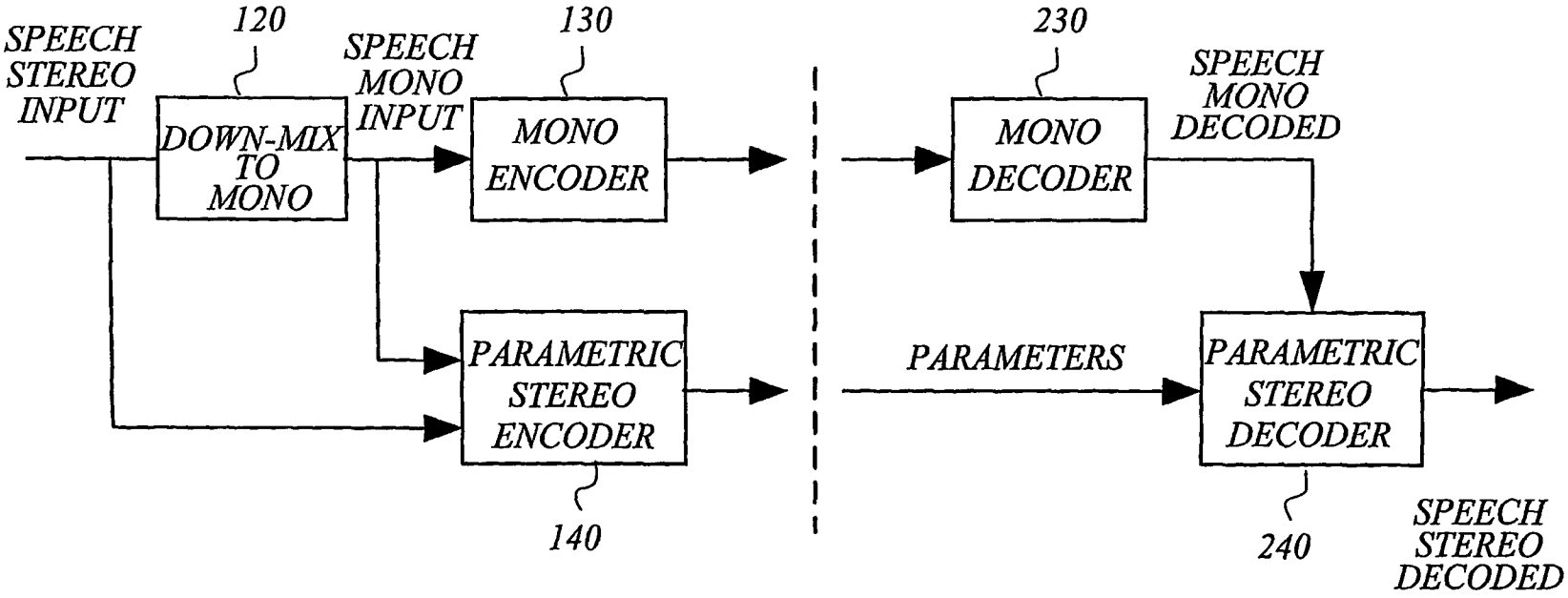
Fig. 3 (Prior art)
FIG. 3 is a schematic block diagram illustrating the basic principles of parametric stereo coding.

Throughout the drawings, the same reference characters will be used for corresponding or similar elements.

The technology disclosed herein relates to multi-channel encoding/decoding techniques in audio applications, and particularly to stereo encoding/decoding in audio transmission systems and/or for audio storage. Examples of possible audio applications include phone conference systems, stereophonic audio transmission in mobile communication systems, various systems for supplying audio services, and multi-channel home cinema systems.

For a better understanding of the technology disclosed herein, it may be useful to begin with a brief overview and analysis of problems with existing technology. Today, there are no standardized codecs available providing high stereophonic or multi-channel audio quality at bit rates which are economically interesting for use in e.g. mobile communication systems, as mentioned previously. What is possible with available codecs is monophonic transmission and/or storage of the audio signals. To some extent also stereophonic transmission or storage is available, but bit rate limitations usually require limiting the stereo representation quite drastically.

The problem with the state-of-the-art multi-channel coding techniques is that they require high bit rates in order to provide good quality. Intensity stereo, if applied at low bit rates as low as e.g. only a few kbps suffers from the fact that it does not provide any temporal inter-channel information. As this information is perceptually important for low frequencies below e.g. 2 kHz, it is unable to provide a stereo impression at such low frequencies.

BCC on the other hand is able to reproduce the stereo or multi-channel image even at low frequencies at low bit rates of e.g. 3 kbps since it also transmits temporal inter-channel information. However, this technique requires computationally demanding time-frequency transforms on each of the channels both at the encoder and the decoder. Moreover, BCC does not attempt to find a mapping from the transmitted mono signal to the channel signals in a sense that their perceptual differences to the original channel signals are minimized.

The LMS technique, also referred to as inter-channel prediction (ICP), for multi-channel encoding, see [4], allows lower bit rates by omitting the transmission of the residual signal. To derive the channel reconstruction filter, an unconstrained error minimization procedure calculates the filter such that its output signal matches best the target signal. In order to compute the filter, several error measures may be used. The mean square error or the weighted mean square error are well known and are computationally cheap to implement.

One could say that in general, most of the state-of-the-art methods have been developed for coding of high-fidelity audio signals or pure speech. In speech coding, where the signal energy is concentrated in the lower frequency regions, sub-band coding is rarely used. Although methods as BCC allow for low bit-rate stereo speech, the sub-band transform coding processing increases both complexity and delay.

There has been a long debate on whether linear inter-channel prediction (ICP) applied to audio coding would increase the compression rate for multi-channel signals.

Research concludes that even though ICP coding techniques do not provide good results for high-quality stereo signals, for stereo signals with energy concentrated in the lower frequencies, redundancy reduction is possible [7]. The whitening effects of the ICP filtering increase the energy in the upper frequency regions, resulting in a net coding loss for perceptual transform coders. These results have been confirmed in [9] and [10] where quality enhancements have been reported only for speech signals.

Figure 4:
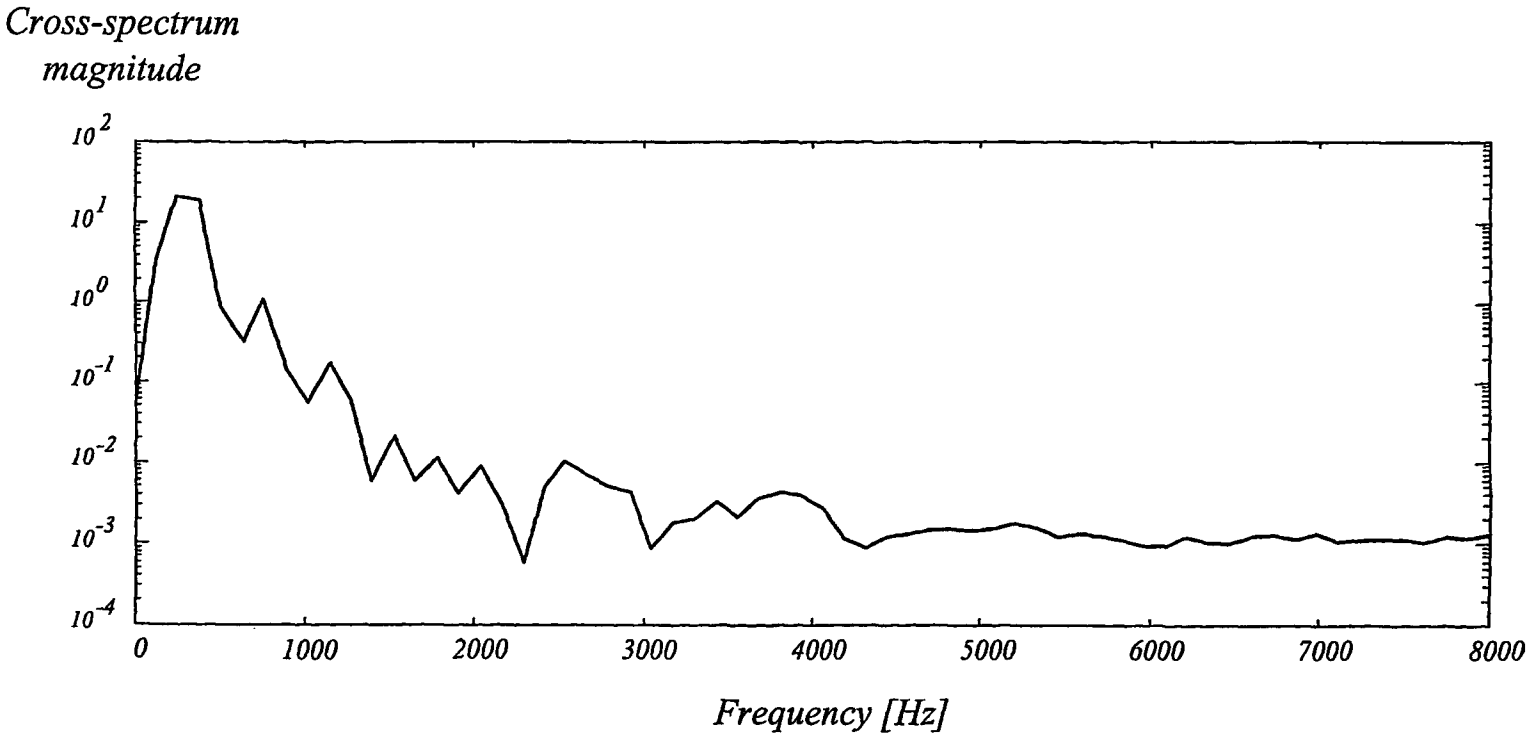
FIG. 4 is a diagram illustrating the cross spectrum of mono and side signals.

The accuracy of the ICP reconstructed signal is governed by the present inter-channel correlations. Bauer et al. [11] did not find any linear relationship between left and right channels in audio signals. However, as can be seen from the cross spectrum of the mono and side signals in FIG. 4, strong inter-channel correlation is found in the lower frequency regions (0-2000 Hz) for speech signals.

In the event of low inter-channel correlations, the ICP filter, as means for stereo coding, will produce a poor estimate of the target signal. The produced estimate is poor even before quantization of the filters. Therefore increasing the number of allocated bits for filter quantization does not lead to better performance or the improvement in performance is quite small.

This effect of saturation of performance of ICP and in general of parametric methods makes these techniques quite inefficient in terms of bit usage. Some bits could be used for e.g. non-parametric coding techniques instead, which in turn could result in greater overall improvement in performance. Moreover, these parametric techniques are not asymptotically optimal since even at a high bit rate, characteristic artifacts inherent in the coding method will not disappear.

Figure 5:
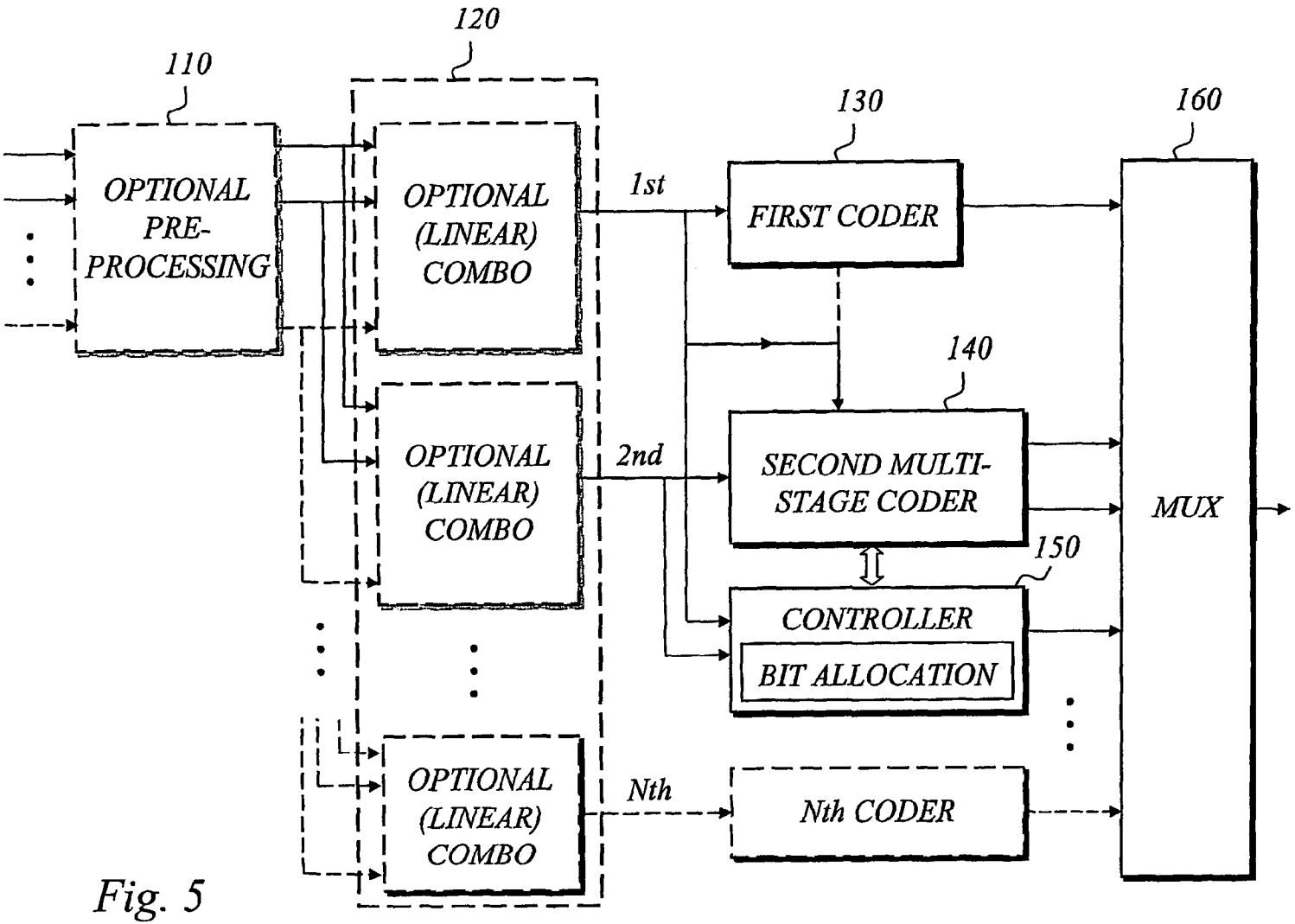
FIG. 5 is a schematic block diagram of a multi-channel encoder according to an exemplary preferred embodiment of the technology disclosed herein.

FIG. 5 is a schematic block diagram of a multi-channel encoder according to an exemplary preferred embodiment of the technology disclosed herein. The multi-channel encoder basically comprises an optional pre-processing unit 110, an optional (linear) combination unit 120, a first encoder 130, at least one additional (second) encoder 140, a controller 150 and an optional multiplexor (MUX unit 160.

The multi-channel or polyphonic signal may be provided to the optional pre-processing unit 110, where different signal conditioning procedures may be performed. The signals of the input channels can be provided from an audio signal storage (not shown) or "live", e.g. from a set of microphones (not shown). The audio signals are normally digitized, if not already in digital form, before entering the multi-channel encoder.

The (optionally pre-processed) signals may be provided to an optional signal combination unit 120, which includes a number of combination modules for performing different signal combination procedures, such as linear combinations of the input signals to produce at least a first signal and a second signal. For example, the first encoding process may be a main encoding process and the first signal representation may be a main signal representation. The second encoding process, which is a multi-stage process, may for example be an auxiliary (side) signal process, and the second signal representation may then be an auxiliary (side) signal representation such as a stereo side signal. In traditional stereo coding, for example, the L and R channels are summed, and the sum signal is divided by a factor of two in order to provide a traditional mono signal as the first (main) signal. The L and R channels may also be subtracted, and the difference signal is divided by a factor of two to provide a traditional side signal as the second signal. According to the technology disclosed herein, any type of linear combination, or any other type of signal combination for that matter, may be performed in the signal combination unit with weighted contributions from at least part of the various channels. The signal combination used by the technology disclosed herein is not limited to two channels but may of course involve multiple channels. It is also possible to generate more than one additional (side) signal, as indicated in FIG. 5. It is even possible to use one of the input channels directly as a first signal, and another one of the input channels directly as a second signal. For stereo coding, for example, this means that the L channel may be used as main signal and the R channel may be used as side signal, or vice versa. A multitude of other variations also exist.

A first signal representation is provided to the first encoder 130, which encodes the first (main) signal according to any suitable encoding principles. Such principles are available in the prior art and will therefore not be further discussed here.

A second signal representation is provided to a second, multi-stage, coder 140 for encoding the second (auxiliary/side) signal.

The overall encoder also comprises a controller 150, which includes at least a bit allocation module for adaptively allocating the available bit budget for the second, multi-stage, signal encoding among the encoding stages of the multi-stage signal encoder 140. The multi-stage encoder may also be referred to as a multi-unit encoder having two or more encoding units.

For example, if the performance of one of the stages in the multi-stage encoder 140 is saturating, there is little meaning to increase the number of bits allocated to this particular encoding stage. Instead it may be better to allocate more bits to another encoding stage in the multi-stage encoder to provide a greater overall improvement in performance. For this reason it turns out to be particularly beneficial to perform bit allocation based on estimated performance of at least one encoding stage. The allocation of bits to a particular encoding stage may for example be based on estimated performance of that encoding stage. Alternatively, however, the encoding bits are jointly allocated among the different encoding stages based on the overall performance of a combination of encoding stages.

Of course, there is an overall bit budget for the entire multi-channel encoder apparatus, which overall bit budget is divided between the first encoder 130 and the multi-stage encoder 140 and possible other encoder modules according to known principles. In the following, we will mainly focus on how to allocate the bit budget available for the multi-stage encoder among the different encoding stages thereof.

Preferably, the bit budget available for the second signal encoding process is adaptively allocated among the different encoding stages of the multi-stage encoder based on predetermined characteristics of the multi-channel audio signal such as inter-channel correlation characteristics. This is particularly useful when the second multi-stage encoder includes a parametric encoding stage such as an inter-channel prediction (ICP) stage. In the event of low inter-channel correlation (e.g. between the first and second signal representations of the input channels), the parametric filter, as a means for multi-channel or stereo coding, will normally produce a relatively poor estimate of the target signal. Therefore, increasing the number of allocated bits for filter quantization does not lead to significantly better performance. The effect of saturation of the performance of the (ICP) filter, and in general of parametric coding, makes these techniques quite inefficient in terms of bit usage. In fact, the bits could be used for different encoding in another encoding stage, such as e.g. non-parametric coding, which in turn could result in greater overall improvement in performance.

In a particular embodiment, the technology disclosed herein involves a hybrid parametric and non-parametric multi-stage signal encoding process and overcomes the problem of parametric quality saturation by exploiting the strengths of parametric representations and non-parametric coding based on efficient allocation of available encoding bits among the parametric and non-parametric encoding stages.

For a particular encoding stage, bits may, as an example, be allocated based on the following procedure:

- estimating performance of the encoding stage as a function of the number of bits assumed to be allocated to the encoding stage;
- assessing estimated performance of the encoding stage; and
- allocating a first amount of bits to the first encoding stage based on the assessment of estimated performance.

If only two stages are used, and a first amount of bits have been allocated to a first stage based on estimated performance, bits may be allocated to a second stage by simply assigning the remaining amount of encoding bits to the second encoding stage.

In general, the bit-allocation can also be made dependent on performance of an additional stage or the overall performance of two or more stages. In the former case, bits can be allocated to an additional encoding stage based on estimated performance of the additional stage. In the latter case, the bit allocation can be based for example on the overall performance of the combination of both parametric and non-parametric representations.

For example, the bit allocation may be determined as the allocation of bits among the different stages of the multi-stage encoder when a change in bit allocation does not lead to significantly better performance according to a suitable criterion. In particular, with respect to performance saturation the number of bits to be allocated to a certain stage may be determined as the number of bits when an increase of the number of allocated bits does not lead to significantly better performance of that stage according to a suitable criterion.

As discussed above, the second multi-stage encoder may include an adaptive inter-channel prediction (ICP) stage for second-signal prediction based on the first signal representation and the second signal representation, as indicated in FIG. 5. The first (main) signal information may equivalently be deduced from the signal encoding parameters generated by the first encoder 130, as indicated by the dashed line from the first encoder. In this context, it may be suitable to use an error encoding stage in "sequence" with the ICP stage. For example, a first adaptive ICP stage for signal prediction generates signal reconstruction data based on the first and second signal representations, and a second encoding stage generates further signal reconstruction data based on the signal prediction error.

Preferably, the controller 150 is configured to perform bit allocation in response to the first signal representation and the second signal representation and the performance of one or more stages in the multi-stage (side) encoder 140.

As illustrated in FIG. 5, a plural number N of signal representations (including also the case when respective input channels are provided directly as separate signals) may be provided. Preferably, the first signal representation is a main signal, and the remaining N−1 signal representations are auxiliary signals such as side signals. Each auxiliary signal is preferably encoded separately in a dedicated auxiliary (side) encoder, which may or may not be a multi-stage encoder with adaptively controlled bit allocation.

The output signals of the various encoders 130, 140, including bit allocation information from the controller 150, are preferably multiplexed into a single transmission (or storage) signal in the multiplexer unit 160. However, alternatively, the output signals may be transmitted (or stored) separately.

In an extension of the technology disclosed herein it may also be possible to select a combination of bit allocation and filter dimension/length to be used (e.g. for inter-channel prediction) so as to optimize a measure representative of the performance of the second signal encoding process. There will be a trade-off between selected filter dimension/length and the imposed quantization error, and the idea is to use a performance measure and find an optimum value by varying the filter length and the required amount of bits accordingly.

Although encoding/decoding and the associated bit allocation is often performed on a frame-by-frame basis, it is envisaged that encoding/decoding and bit allocation can be performed on variable sized frames, allowing signal adaptive optimized frame processing. This also enables the possibility to provide an even higher degree of freedom to optimize the performance measure, as will be explained later on.

Figure 6:
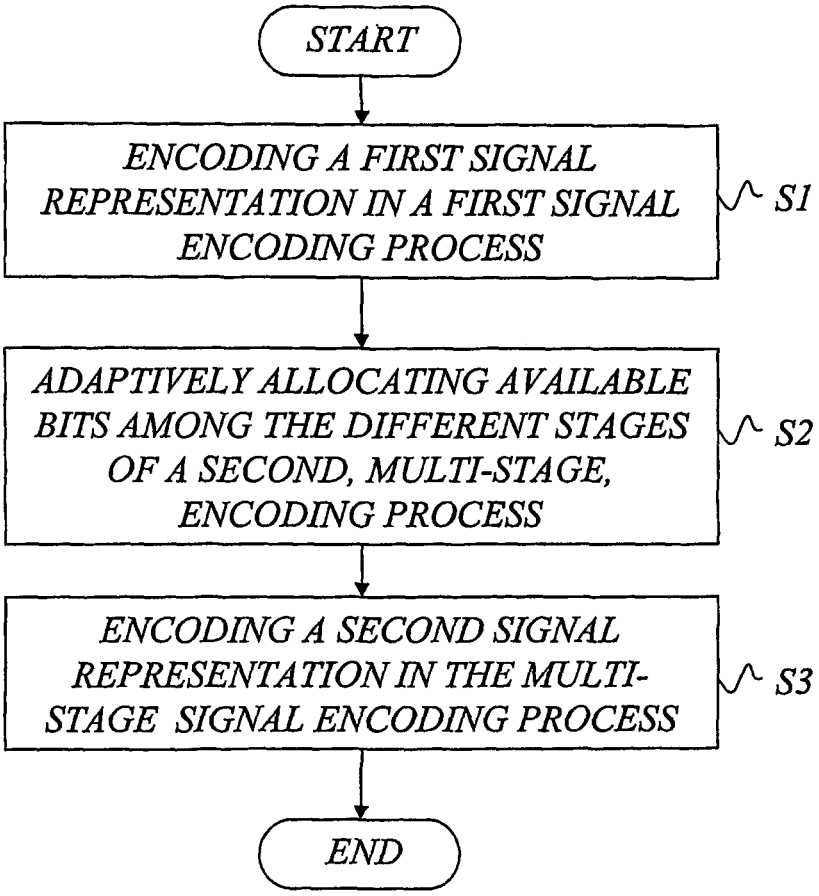
FIG. 6 is a schematic flow diagram setting forth a basic multi-channel encoding procedure according to a preferred embodiment of the technology disclosed herein.

FIG. 6 is a schematic flow diagram setting forth a basic multi-channel encoding procedure according to a preferred embodiment of the technology disclosed herein. In step S1, a first signal representation of one or more audio channels is encoded in a first signal encoding process. In step S2, the available bit budget for second signal encoding is allocated among the different stages of a second, multi-stage, signal encoding process in dependence on multi-channel input signal characteristics such as inter-channel correlation, as outlined above. The allocation of bits among the different stages may generally vary on a frame-to-frame basis. Further detailed embodiments of the bit allocation proposed by the technology disclosed herein will be described later on. In step S3, the second signal representation is encoded in the second, multi-stage, signal encoding process accordingly.

Figure 7:
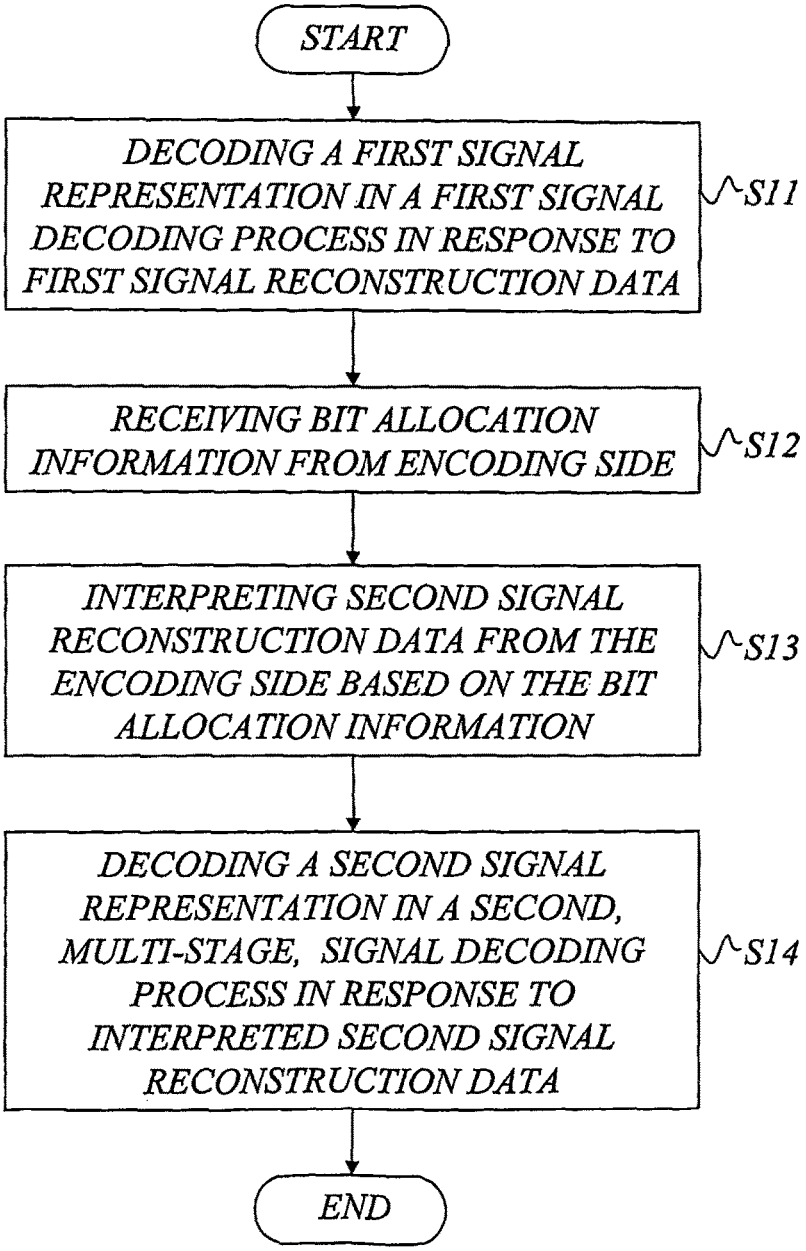
FIG. 7 is a schematic flow diagram setting forth a corresponding multi-channel decoding procedure according to a preferred embodiment of the technology disclosed herein.

FIG. 7 is a schematic flow diagram setting forth a corresponding multi-channel decoding procedure according to a preferred embodiment of the technology disclosed herein. In step S11, the encoded first signal representation is decoded in a first signal decoding process in response to first signal reconstruction data received from the encoding side. In step S12, dedicated bit allocation information is received from the encoding side. The bit allocation information is representative of how the bit budget for second-signal encoding has been allocated among the different encoding stages on the encoding side. In step S13, second signal reconstruction data received from the encoding side is interpreted based on the received bit allocation information. In step S14, the encoded second signal representation is decoded in a second, multi-stage, signal decoding process based on the interpreted second signal reconstruction data.

The overall decoding process is generally quite straight forward and basically involves reading the incoming data stream, interpreting data, inverse quantization and final reconstruction of the multi-channel audio signal. More details on the decoding procedure will be given later on with reference to an exemplary embodiment of the technology disclosed herein.

Although the following description of exemplary embodiments mainly relates to stereophonic (two-channel) encoding and decoding, it should be kept in mind that the technology disclosed herein is generally applicable to multiple channels. Examples include but are not limited to encoding/decoding 5.1 (front left, front centre, front right, rear left and rear right and subwoofer) or 2.1 (left, right and center subwoofer) multi-channel sound.

Figure 8:
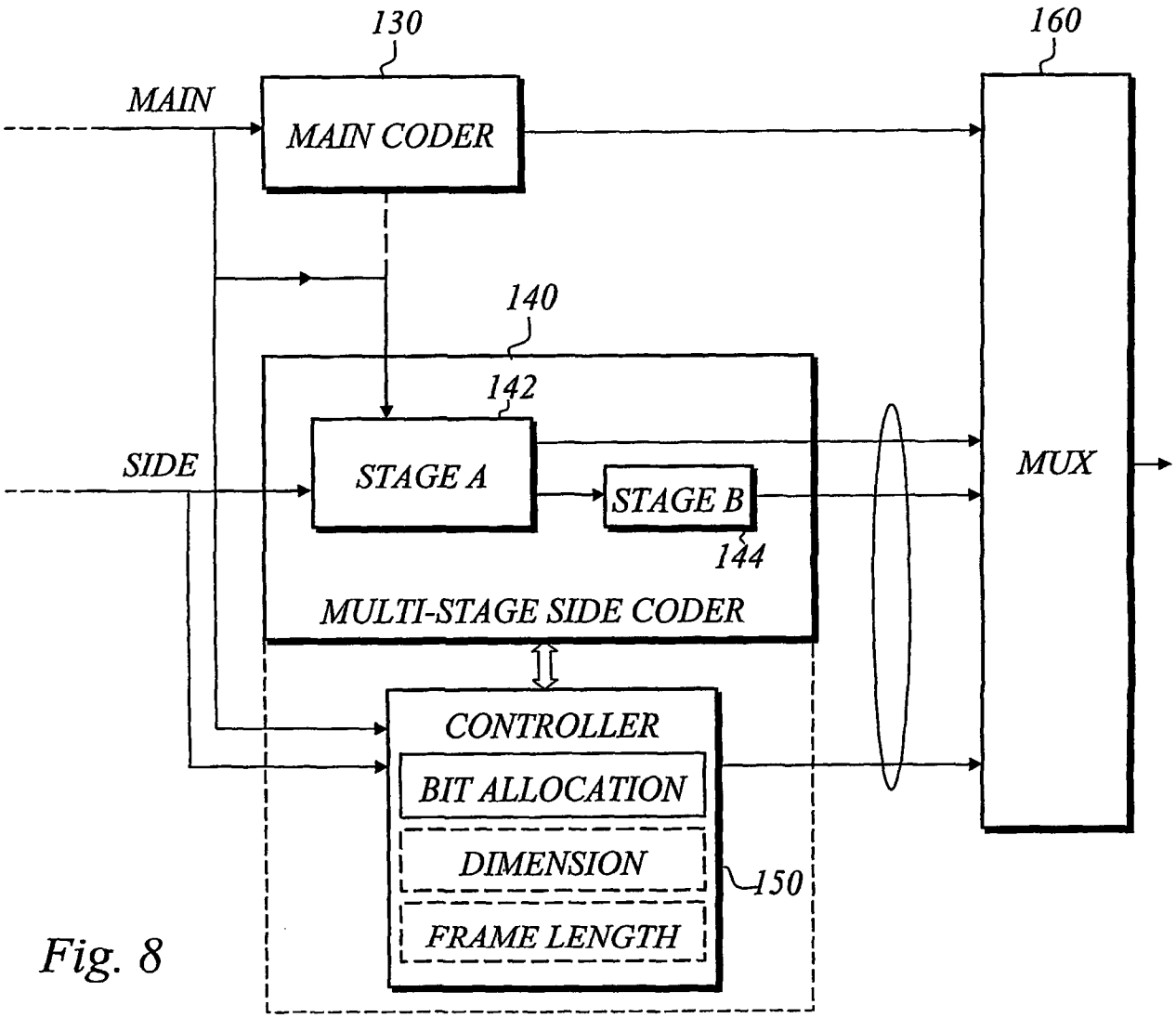
FIG. 8 is a schematic block diagram illustrating relevant parts of a (stereo) encoder according to an exemplary preferred embodiment of the technology disclosed herein.

FIG. 8 is a schematic block diagram illustrating relevant parts of a (stereo) encoder according to an exemplary preferred embodiment of the technology disclosed herein. The (stereo) encoder basically comprises a first (main) encoder 130 for encoding a first (main) signal such as a typical mono signal, a second multi-stage (auxiliary/side) encoder 140 for (auxiliary/side) signal encoding, a controller 150 and an optional multiplexor unit 160. In this particular example, the auxiliary/side encoder 140 comprises two (or more) stages 142, 144. The first stage 142, stage A, generates side signal reconstruction data such as quantized filter coefficients in response to the main signal and the side signal. The second stage 144, stage B, is preferably a residual coder, which encodes/quantizes the residual error from the first stage 142, and thereby generates additional side signal reconstruction data for enhanced stereo reconstruction quality. The controller 150 comprises a bit allocation module, an optional module for controlling filter dimension and an optional module for controlling variable frame length processing. The controller 150 provides at least bit allocation information representative of how the bit budget available for side signal encoding is allocated among the two encoding stages 142, 144 of the side encoder 140 as output data. The set of information comprising quantized filter coefficients, quantized residual error and bit allocation information is preferably multiplexed together with the main signal encoding parameters into a single transmission or storage signal in the multiplexor unit 160.

Figure 9:
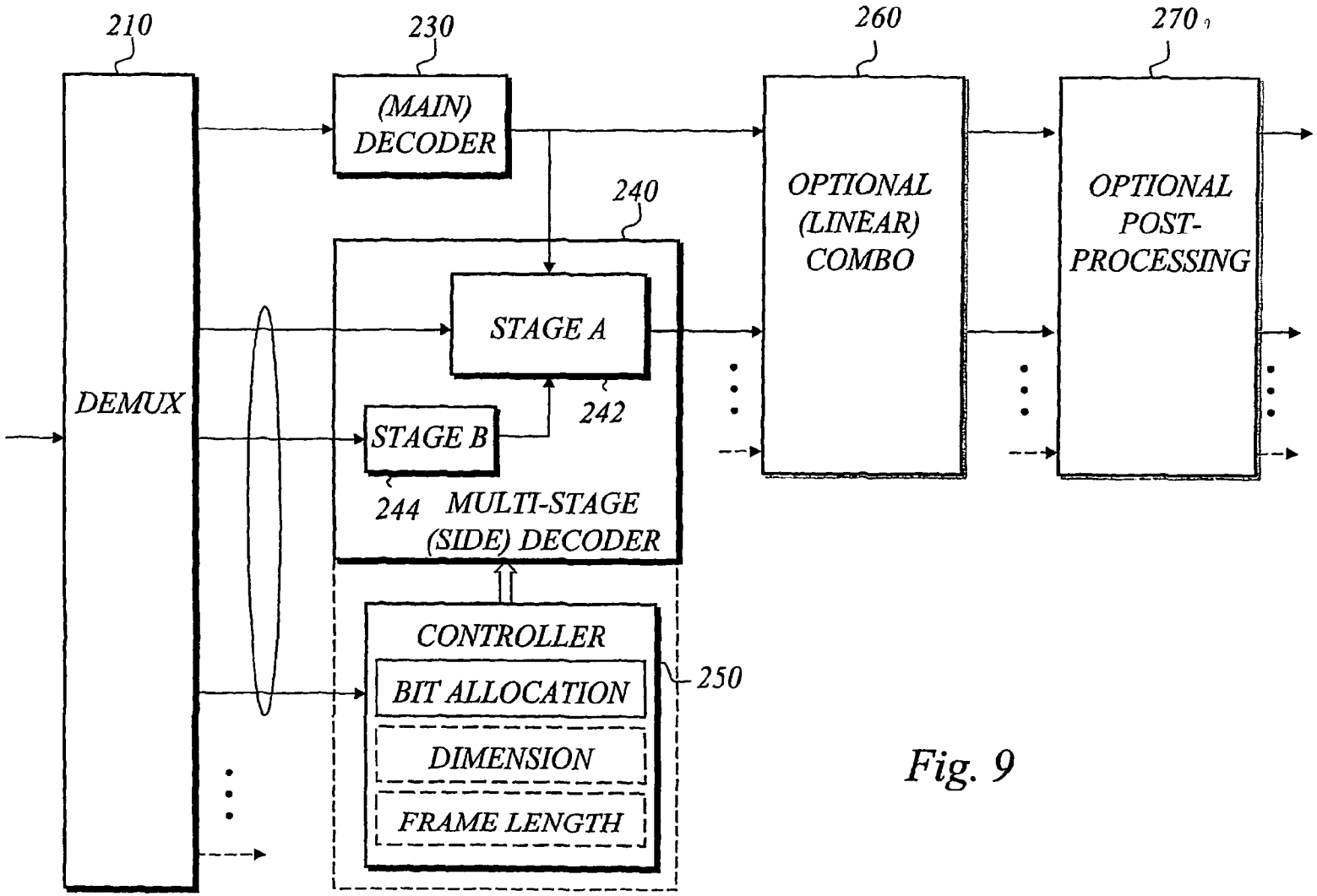
FIG. 9 is a schematic block diagram illustrating relevant parts of a (stereo) decoder according to an exemplary preferred embodiment of the technology disclosed herein.

FIG. 9 is a schematic block diagram illustrating relevant parts of a (stereo) decoder according to an exemplary preferred embodiment of the technology disclosed herein. The (stereo) decoder basically comprises an optional demultiplexor unit 210, a first (main) decoder 230, a second (auxiliary/side) decoder 240, a controller 250, an optional signal combination unit 260 and an optional post-processing unit 270. The demultiplexor 210 preferably separates the incoming reconstruction information such as first (main) signal reconstruction data, second (auxiliary/side) signal reconstruction data and control information such as bit allocation information. The first (main) decoder 230 "reconstructs" the first (main) signal in response to the first (main) signal reconstruction data, usually provided in the form of first (main) signal representing encoding parameters. The second (auxiliary/side) decoder 240 preferably comprises two (or more) decoding stages 242, 244. The decoding stage 244, stage B, "reconstructs" the residual error in response to encoded/quantized residual error information. The decoding stage 242, stage A, "reconstructs" the second signal in response to the quantized filter coefficients, the reconstructed first signal representation and the reconstructed residual error. The second decoder 240 is also controlled by the controller 250. The controller receives information on bit allocation, and optionally also on filter dimension and frame length from the encoding side, and controls the side decoder 240 accordingly.

For a more thorough understanding of the technology disclosed herein, the technology disclosed herein will now be described in more detail with reference to various exemplary embodiments based on parametric coding principles such as inter-channel prediction.

Parametric Stereo Coding Using Inter-channel Prediction

In general, inter-channel prediction (ICP) techniques utilize the inherent inter-channel correlation between the channels. In stereo coding, channels are usually represented by the left and the right signals l(n), r(n), an equivalent representation is the mono signal m(n) (a special case of the main signal) and the side signal s(n). Both representations are equivalent and are normally related by the traditional matrix operation:

$$\begin{bmatrix} m(n) \\ s(n) \end{bmatrix} = \frac{1}{2}\begin{bmatrix} 1 & 1 \\ 1 & -1 \end{bmatrix}\begin{bmatrix} l(n) \\ r(n) \end{bmatrix} \tag{1}$$

Figure 10A:
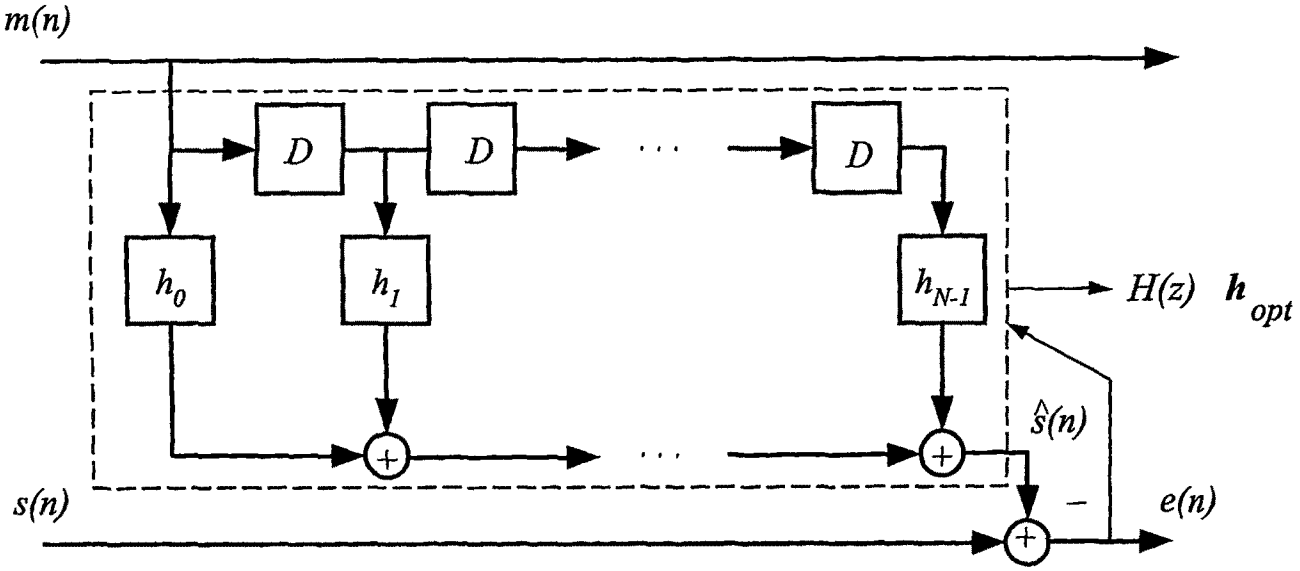
FIG. 10A illustrates side signal estimation using inter-channel prediction (FIR) filtering.

As illustrated in FIG. 10A, the ICP technique aims to represent the side signal s(n) by an estimate ŝ(n), which is obtained by filtering the mono signal m(n) through a time-varying FIR filter H(z) having N filter coefficients $h_t(i)$:

$$\hat{s}(n) = \sum_{i=0}^{N-1} h_t(i)m(n-i) \tag{2}$$

It should be noted that the same approach could be applied directly on the left and right channels.

The ICP filter derived at the encoder may for example be estimated by minimizing the mean squared error (MSE), or a related performance measure, for instance psycho-acoustically weighted mean square error, of the side signal prediction error e(n); The MSE is typically given by:

$$\xi(h) = \sum_{n=0}^{L-1} MSE(n, h) = \sum_{n=0}^{L-1}\left(s(n) - \sum_{i=0}^{N-1} h(i)m(n-i)\right)^2 \tag{3}$$

where L is the frame size and N is the length/order/dimension of the ICP filter. Simply speaking, the performance of the ICP filter, thus the magnitude of the MSE, is the main factor determining the final stereo separation. Since the side signal describes the differences between the left and right channels, accurate side signal reconstruction is essential to ensure a wide enough stereo image.

The optimal filter coefficients are found by minimizing the MSE of the prediction error over all samples and are given by:

$$h_{opt}^T R = r \Rightarrow h_{opt} = R^{-1} r \tag{4}$$

In (4) the correlations vector r and the covariance matrix R are defined as:

$$r = Ms$$

$$R = MM^T \tag{5}$$

where $$s = [s(0) \;\; s(1) \;\; \ldots \;\; s(L-1)]^T, \tag{6}$$

$$M = \begin{bmatrix} m(0) & m(1) & \ldots & m(L-1) \\ m(-1) & m(0) & \ldots & m(L-2) \\ \vdots & \ddots & \ddots & \vdots \\ m(-N+1) & \ldots & \ldots & m(L-N) \end{bmatrix}$$

Inserting (5) into (3) one gets a simplified algebraic expression for the Minimum MSE (MMSE) of the (unquantized) ICP filter:

$$\text{MMSE} = \text{MSE}(h_{opt}) = P_{SS} - r^T R^{-1} r \tag{7}$$

where $P_{SS}$ is the power of the side signal, also expressed as $s^T s$.

Inserting $r = Rh_{opt}$ into (7) yields:

$$\text{MMSE} = P_{SS} - r^T R^{-1} R h_{opt} = P_{SS} - r^T h_{opt} \tag{8}$$

LDLT factorization [12] on R gives us the equation system:

$$L\underbrace{DL^T h}_{z} = r \tag{9}$$

Where we first solve z in and iterative fashion:

$$\begin{bmatrix} 1 & 0 & \ldots & 0 \\ l_{21} & 1 & \ddots & \vdots \\ \vdots & \ddots & \ddots & 0 \\ l_{N1} & \ldots & l_{NN-1} & 1 \end{bmatrix}\begin{bmatrix} z_1 \\ z_2 \\ \vdots \\ z_N \end{bmatrix} = \begin{bmatrix} r_1 \\ r_2 \\ \vdots \\ r_N \end{bmatrix} \Rightarrow z_i = r_i - \sum_{j=1}^{i-1} l_{ij} z_j \tag{10}$$

Now we introduce a new vector $q = L^T h$. Since the matrix D only has non-zero values in the diagonal, finding q is straightforward:

$$D_q = z \Rightarrow q_i = \frac{z_i}{d_i},\; i = 1,2, \ldots, N \tag{11}$$

The sought filter vector h can now be calculated iteratively in the same way as (10):

$$\begin{bmatrix} 1 & l_{12} & \ldots & l_{1N} \\ 0 & 1 & \ddots & \vdots \\ \vdots & \ddots & \ddots & l_{N-1N} \\ 0 & \ldots & 0 & 1 \end{bmatrix}\begin{bmatrix} h_1 \\ h_2 \\ \vdots \\ h_N \end{bmatrix} = \begin{bmatrix} q_1 \\ q_2 \\ \vdots \\ q_N \end{bmatrix} \Rightarrow h_i = q_i - \sum_{j=1}^{N-1} l_{i(i+j)} h_{(i+j)}, \quad i = 1,2, \ldots, N \tag{12}$$

Besides the computational savings compared to regular matrix inversion, this solution offers the possibility of efficiently calculating the filter coefficients corresponding to different dimensions n (filter lengths):

$$H = \{h_{opt}^{(n)}\}_{n=1}^{N} \tag{13}$$

The optimal ICP (FIR) filter coefficients $h_{opt}$ may be estimated, quantized and sent to the decoder on a frame-by-frame basis.

Multistage Hybrid Multi-channel Coding by Residual Coding

Figure 10B:
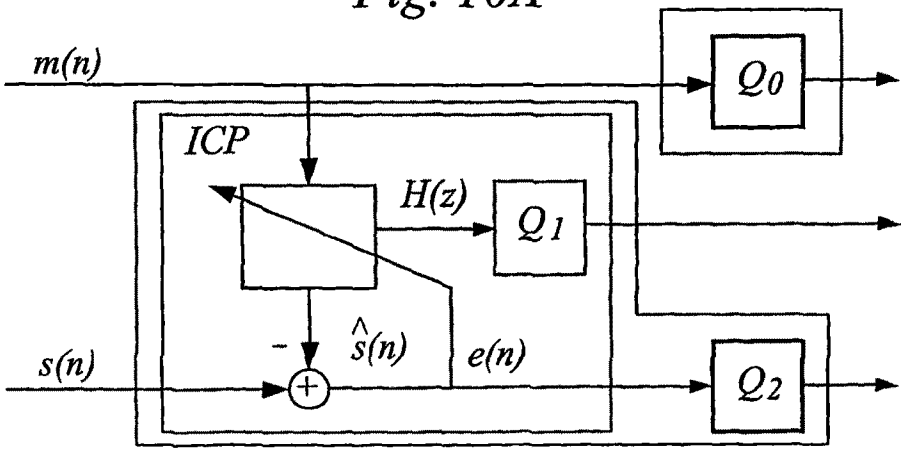
FIG. 10B illustrates an audio encoder with mono encoding and multi-stage hybrid side signal encoding.

FIG. 10B illustrates an audio encoder with mono encoding and multi-stage hybrid side signal encoding. The mono signal m(n) is encoded and quantized ($Q_0$) for transfer to the decoding side as usual. The ICP module for side signal prediction provides a FIR filter representation H(z) which is quantized ($Q_1$) for transfer to the decoding side. Additional quality can be gained by encoding and/or quantizing ($Q_2$) the side signal prediction error e(n). It should be noted that when the residual error is quantized, the coding can no longer be referred to as purely parametric, and therefore the side encoder is referred to as a hybrid encoder.

Adaptive Bit Allocation

The technology disclosed herein is based on the recognition that low inter-channel correlation may lead to bad side signal prediction. On the other hand, high inter-channel correlation usually leads to good side signal prediction.

FIG. 11A is a frequency-domain diagram illustrating a mono signal and a side signal and the inter-channel correlation, simply referred to as cross-correlation, between the mono and side signals. FIG. 11B is a corresponding time-domain diagram illustrating the predicted side signal along with the original side signal.

FIG. 11C is frequency-domain diagram illustrating another mono signal and side signal and their cross-correlation. FIG. 11D is a corresponding time-domain diagram illustrating the predicted side signal along with the original side signal.

It can be seen that high inter-channel correlation yields a good estimate of the target signal, whereas low inter-channel correlation yields a quite poor estimate of the target signal. If the produced estimate is poor even before quantization of the filter, there is usually no sense in allocating a lot of bits for filter quantization. Instead it may be more useful to use at least part of the bits for different encoding such as non-parametric encoding of the side signal prediction error, which could lead to better overall performance. In the case of higher correlation, it may sometimes be possible to quantize the filter with relatively few bits and still get a quite good result. In other instances a larger amount of bits will have to be used for quantization even if the correlation is relatively high, and it has to be decided if it is "economical" from a bit allocation perspective to use this amount of bits.

In a particular exemplary embodiment, the codec is preferably designed based on combining the strengths of both parametric stereo representation as provided by the ICP filters and non-parametric representation such as residual error coding in a way that is made adaptive in dependence on the characteristics of the stereo input signal.

Figure 12:
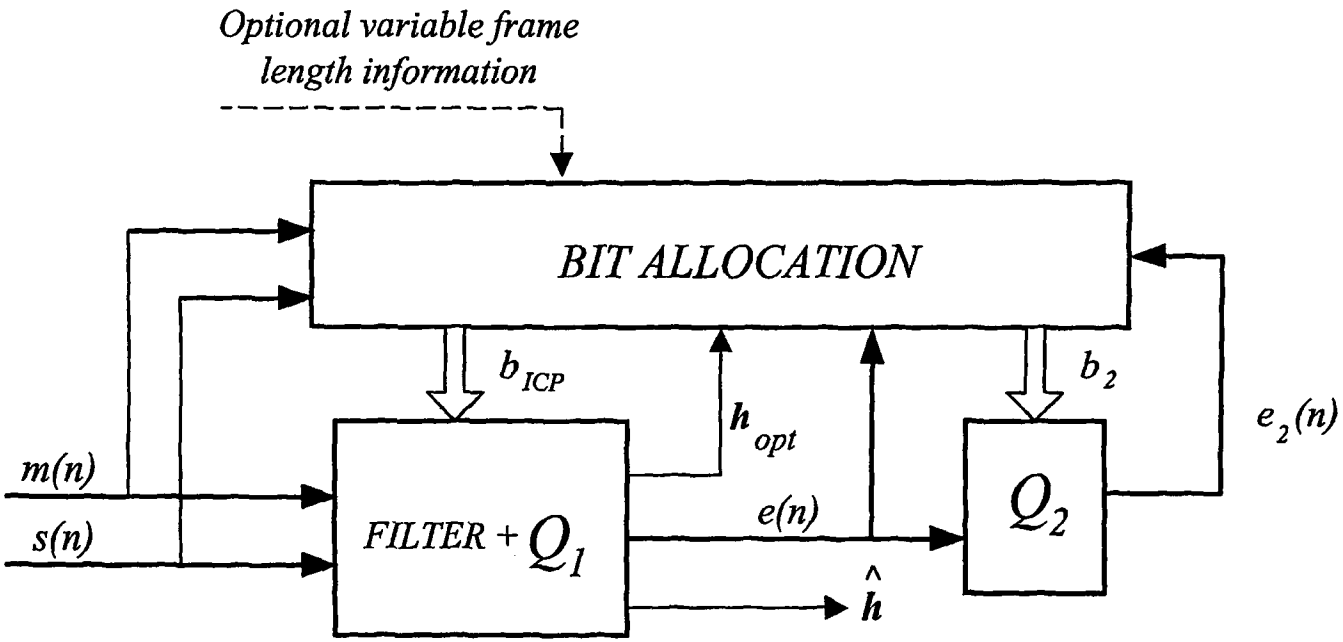
FIG. 12 is a schematic diagram illustrating an adaptive bit allocation controller, in association with a multi-stage side encoder, according to a particular exemplary embodiment of the technology disclosed herein.

FIG. 12 is a schematic diagram illustrating an adaptive bit allocation controller, in association with a multi-stage side encoder, according to a particular exemplary embodiment of the technology disclosed herein.

As hinted above, to fully exploit the available bit budget and in order to further enhance the quality of the stereo signal reconstruction, at least a second quantizer will have to be used to prevent all bits from going to the quantization of the prediction filter. The use of a second quantizer provides an additional degree of freedom that is exploited by the present technology disclosed herein. The multi-stage encoder thus includes a first parametric stage with a filter such as an ICP filter and an associated first quantizer Q.sub.1, and a second stage based on a second quantizer Q.sub.2.

Preferably, the prediction error of the ICP filter, i.e. $e(n)=s(n)-\hat{s}(n)$, is quantized by using a non-parametric coder, typically a waveform coder or a transform coder or a combination of both. It should though be understood that it is possible to use other types of coding of the prediction error such as CELP (Code Excited Linear Prediction) coding.

It is assumed that the total bit budget for the side signal encoding process is $B=b_{ICP}+b_2$, where $b_{ICP}$ is the number of bits for quantization of the ICP filter, and $b_2$ is the number of bits for quantization of the residual error e(n).

Optimally, the bits are jointly allocated among the different encoding stages based on the overall performance of the encoding stages, as schematically indicated by the inputs of e(n) and $e_2(n)$ into the bit allocation module of FIG. 12. It may be reasonable to strive for minimization of the total error $e_2(n)$ in a perceptually weighted sense.

In a simpler and more straightforward implementation, the bit allocation module allocates bits to the first quantizer depending on the performance of the first parametric (ICP) filtering procedure, and allocates the remaining bits to the second quantizer. Performance of the parametric (ICP) filter is preferably based on a fidelity criterion such as the MSE or perceptually weighted MSE of the prediction error e(n).

The performance of the parametric (ICP) filter is typically varying with the characteristics of the different signal frames as well as the available bit-rate.

For instance, in the event of low inter-channel correlations, the ICP filtering procedure will produce a poor estimate of the target (side) signal even prior to filter quantization. Thus, allocating more bits will not lead to big performance improvement. Instead, it is better to allocate more bits to the second quantizer.

In other instances, the redundancy between the mono signal and the side signal is fully removed by the sole use of the ICP filter quantized with a certain bit-rate, and thus allocating more bits to the second quantizer would be inefficient.

The inherent limitations of the performance of ICP follow as a direct consequence of the degree of correlation between the mono and the side signal. The performance of the ICP is always limited by the maximum achievable performance provided by the un-quantized filters.

Figure 13:
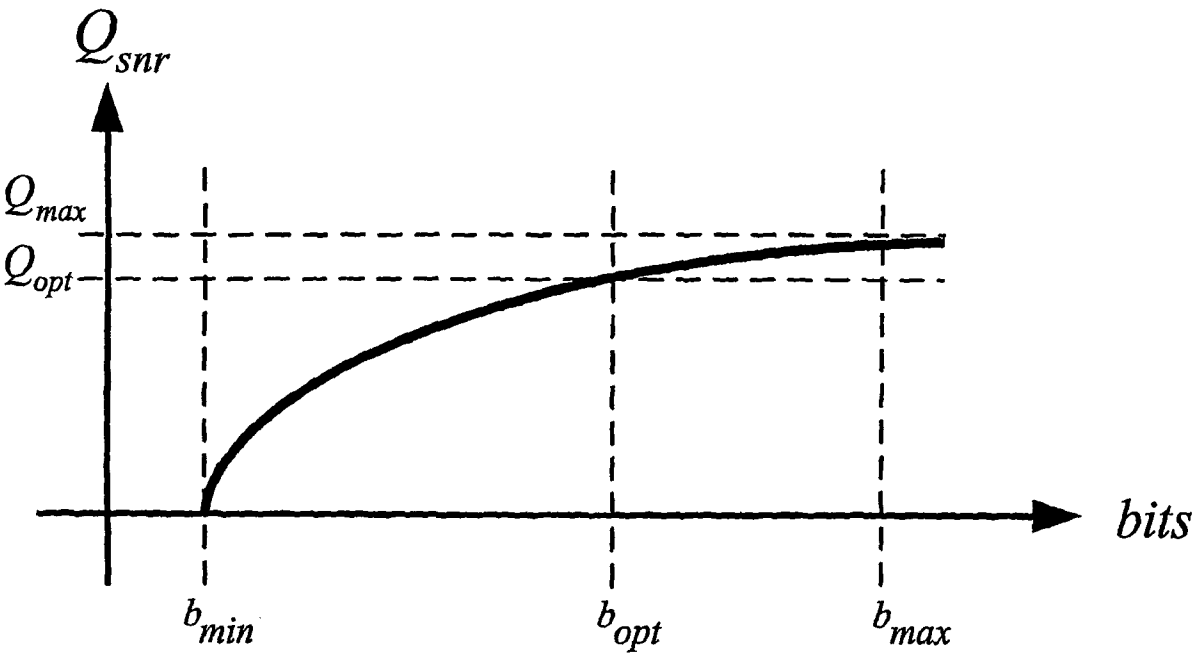
FIG. 13 is a schematic diagram illustrating the quality of a reconstructed side signal as a function of bits used for quantization of the ICP filter coefficients.

FIG. 13 shows a typical case of how the performance of the quantized ICP filter varies with the amount of bits. Any general fidelity criterion may be used. A fidelity criterion in the form of a quality measure Q may be used. Such a quality measure may for example be based on a signal-to-noise (SNR) ratio, and is then denoted $Q_{snr}$. For example, a quality measure based on a ratio between the power of the side signal and the MSE of the side signal prediction error e(n):

$$Q_{snr} = \frac{P_{ss}}{P_{ee}} = \frac{s^T s}{MSE} \tag{14}$$

There is a minimum bit-rate $b_{min}$ for which the use of ICP provides an improvement which is characterized by a value for $Q_{snr}$ which is greater than 1, i.e. 0 dB. Obviously, when the bit-rate increases, the performance reaches that of the unquantized filter $Q_{max}$. On the other hand, allocating more than $b_{max}$ bits for quantization would lead to quality saturation.

Typically, a lower bit-rate is selected ($b_{opt}$ in FIG. 13) from which rate the performance increase is no longer significant according to a suitable criterion. The selection criterion is normally designed in dependence on the particular application and the specific requirements thereof.

For some problematic signals, where mono/side correlations is close to zero, it is better not to use any ICP filtering at all, and instead allocate the whole bit budget to the secondary quantizer. For the same type of signals, if the performance of the secondary quantizer is insufficient, then the signal may be coded using pure parametric ICP filtering.

In general, the filter coefficients are treated as vectors, which are efficiently quantized using vector quantization (VQ). The quantization of the filter coefficients is one of the most important aspects of the ICP coding procedure. As will be seen, the quantization noise introduced on the filter coefficients can be directly related to the loss in MSE.

The MMSE has previously been defined as:

$$\mathrm{MMSE}=s^T s-r^T h_{opt}=s^T s-2h_{opt}^T r+h_{opt}^T R h_{opt} \tag{15}$$

Quantizing $h_{opt}$ introduces a quantization error e: $\hat{h}=h_{opt}+e$. The new MSE can now be written as:

$$\begin{aligned} MSE(h_{opt}+e) &= s^T s - 2(h_{opt}+e)^T r + (h_{opt}+e)^T R(h_{opt}+e) \\ &= MMSE + e^T R h_{opt} + e^T R e + h_{opt}^T R e - 2e^T r \\ &= MMSE + e^T R e + 2e^T R h_{opt} - 2e^T r \end{aligned} \tag{16}$$

Since $Rh_{opt}=r$, the last two terms in (16) cancel out and the MSE of the quantized filter becomes:

$$\mathrm{MSE}(\hat{h})=s^T s-r^T h_{opt}+e^T R e \tag{17}$$

What this means is that in order to have any prediction gain at all the quantization error term has to be lower than the prediction term, i.e. $r^T h_{opt}>e^T Re$.

Figure 14:
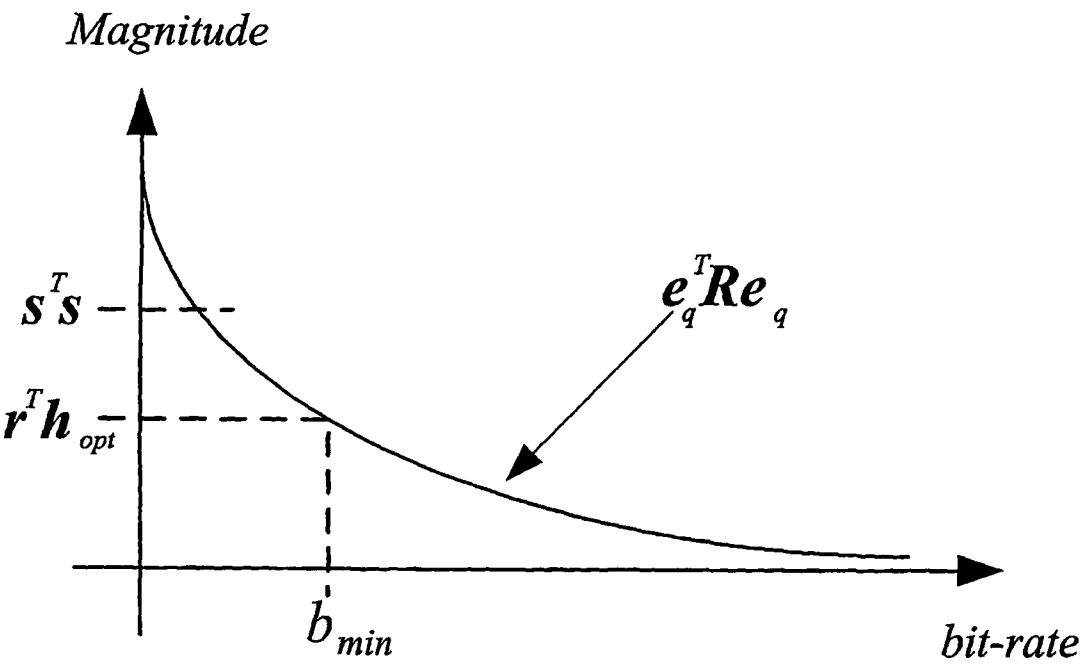
FIG. 14 is a schematic diagram illustrating prediction feasibility.

From FIG. 14 it can be seen that allocating less than $b_{min}$ bits for the ICP filter quantization does not reduce the side signal prediction error energy. In fact, the energy of the prediction error is larger than that of the target side signal, making it unreasonable to use ICP filtering at all. This of course sets a lower limit for the usability of ICP as means for signal representation and encoding. Therefore, a bit-allocation controller would in the preferred embodiment consider this as a lower bound for ICP.

Direct quantization of the filter coefficients leads in general to bad results, rather one should quantize the filters in order to minimizing the term $e^T Re$. An example of a desired distortion measure is given by:

$$\begin{aligned} d_w(h_{opt}, \hat{h}) &= (h_{opt}-\hat{h})^T R(h_{opt}-\hat{h}) \\ &= \sum_{i=0}^{N-1}\sum_{j=0}^{N-1}(h_{opt}(i)-\hat{h}(i))R(i,j)(h_{opt}(j)-\hat{h}(j)) \end{aligned} \tag{18}$$

This suggests the usage of a weighted vector quantization (VQ) procedure. Similar weighted quantizers have been used in [8] for speech compression algorithms.

A clear benefit could also be gained in terms of bit-rate if one uses predictive weighted vector quantization. In fact, prediction filters that result from the above-described concepts are in general correlated in time.

Returning once again to FIG. 12, it can be understood that the bit allocation module needs the main signal m(n) and side signal s(n) as input in order to calculate the correlations vector r and the covariance matrix R. Clearly, $h_{opt}$ is also required for the MSE calculation of the quantized filter. From the MSE, a corresponding quality measure can be estimated, and used as a basis for bit allocation. If variable sized frames are used, it is generally necessary to provide information on the frame size to the bit allocation module.

Figure 15:
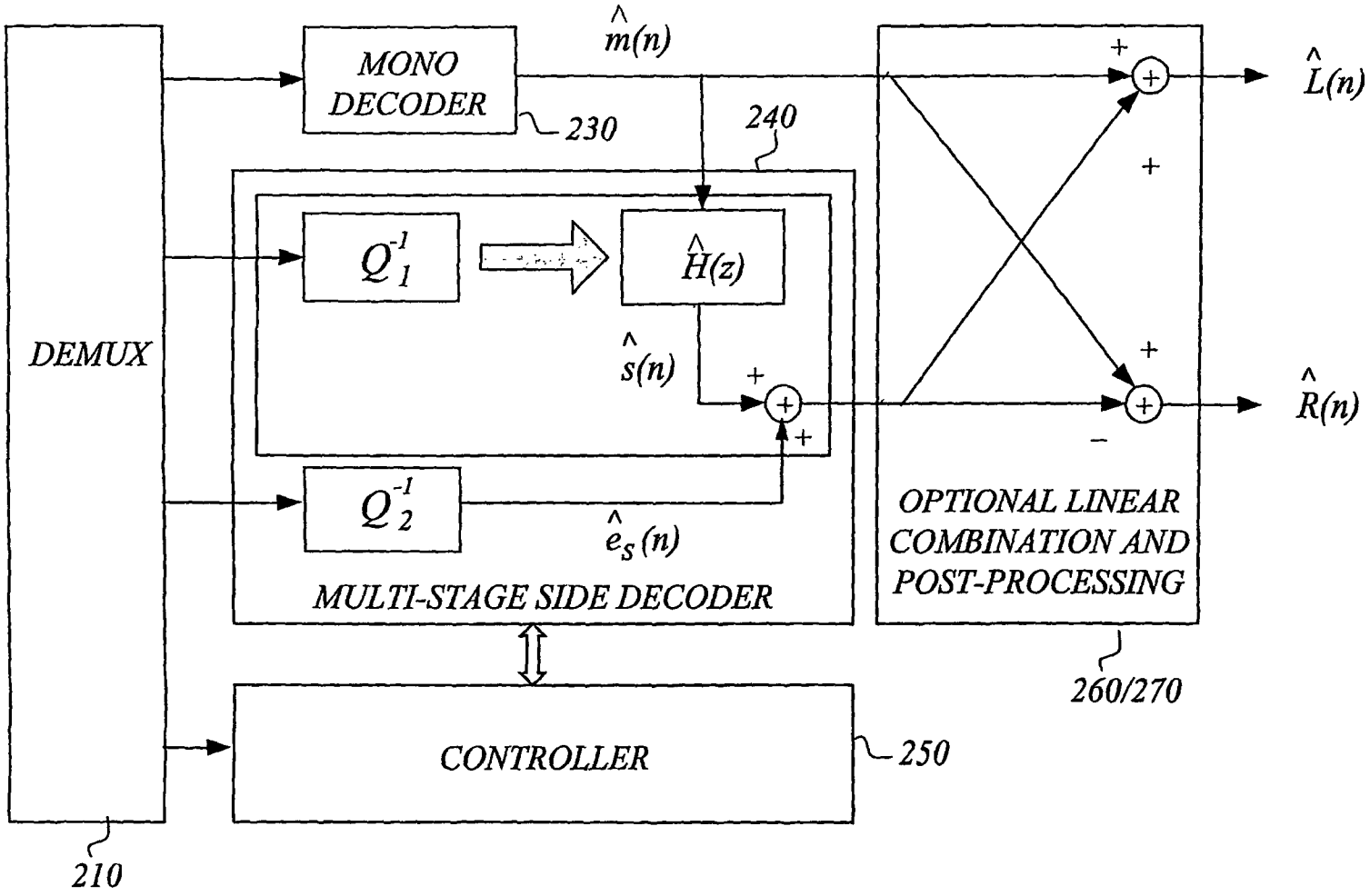
FIG. 15 illustrates a stereo decoder according to preferred exemplary embodiment of the technology disclosed herein.

With reference to FIG. 15, which illustrates a stereo decoder according to preferred exemplary embodiment of the invention, the decoding procedure will be explained in more detail. A demultiplexor may be used for separating the incoming stereo reconstruction data into mono signal reconstruction data, side signal reconstruction data, and bit allocation information. The mono signal is decoded in a mono decoder, which generates a reconstructed main signal estimate $\hat{m}(n)$. The filter coefficients are decoded by inverse quantization to reconstruct the quantized ICP filter $\hat{H}(z)$. The side signal $\hat{s}(n)$ is reconstructed by filtering the reconstructed mono signal $\hat{m}(n)$ through the quantized ICP filter $\hat{H}(z)$. For improved quality, the prediction error $\hat{e}_s(n)$ is reconstructed by inverse quantization $Q_2^{-1}$ and added to the side signal estimate $\hat{s}(n)$. Finally, the output stereo signal is obtained as:

$$\begin{cases} \hat{L}(n) = \hat{m}(n) + \sum_{i=0}^{N-1} h_q(i)\hat{m}(n-i) + \hat{e}_s(n) \\ \hat{R}(n) = \hat{m}(n) - \sum_{i=0}^{N-1} h_q(i)\hat{m}(n-i) - \hat{e}_s(n) \end{cases} \tag{19}$$

It is important to note that the side signal quality, and thus the stereo quality, is affected both by the accuracy of the mono reproduction and the ICP filter quantization as well as the residual error encoding.

Variable Rate—Variable Dimension Filtering

As previously mentioned, it is also possible to select a combination of bit allocation and filter dimension/length to be used (e.g. for inter-channel prediction) so as to optimize a given performance measure.

It may for example be convenient to select a combination of number of bits to be allocated to the first encoding stage and filter length to be used in the first encoding stage so as to optimize a measure representative of the performance of the first encoding stage or a combination of encoding stages in a multi-stage (auxiliary/side) encoder.

For example, given that a non-parametric coder accompanies a parametric coder, the target of the ICP filtering may be to minimize the MSE of the prediction error. Increasing the filter dimension is known to decrease the MSE. However, for some signal frames the mono and side signals only differ in amplitude and not in time alignment. Thus, one filter coefficient would suffice for this case.

As discussed earlier, it is possible to calculate the filter coefficients for the different dimensions iteratively. Since the filter is completely determined by the symmetric R matrix and r vector, it is also possible to calculate the MMSE of the different dimensions iteratively. Inserting $q=L^{-T}h_{opt}$ into (8) yields:

$$\begin{aligned} MMSE &= P_{SS} - q^T L^{-1} L D L^T L^{-T} q \\ &= P_{SS} - q^T D q \\ &= P_{SS} - \sum_{i=1}^{N} d_i q_i^2 \end{aligned} \tag{20}$$

where $d_i \geq 0$, $\forall i$. Thus increasing the filter order decreases the MMSE. Hence, it is possible to compute the provided gain of an additional filter dimension without having to recalculate $r^T h_{opt}$ for every dimension.

For some frames, the gain of using long filters is noticeable, whereas for others the performance increase by using long filters is nearly negligible. This is explained by the fact that maximum de-correlation between the channels can be achieved without using a long filter. This holds especially true for frames where the amount of inter-channel correlation is low.

Figure 16:
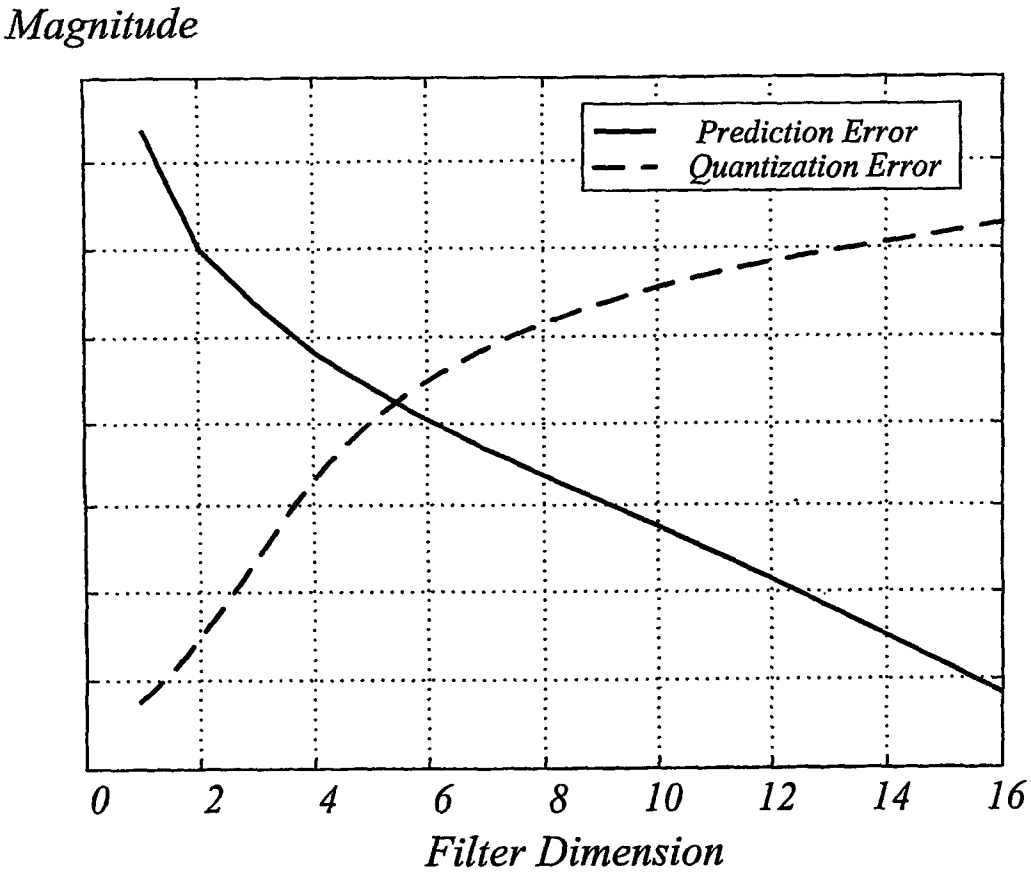
FIG. 16 illustrates an example of an obtained average quantization and prediction error as a function of the filter dimension.

FIG. 16 illustrates average quantization and prediction error as a function of the filter dimension. The quantization error increases with dimension since the bit-rate is fixed. In all cases, the use of long filters leads to a better performance. However, quantization of a longer vector yields a larger quantization error if the bit-rate is held fixed, as illustrated in FIG. 16. With increased filter length, comes the possibility of increased performance but to reach the performance gain more bits are needed.

The idea of the variable rate/variable dimension scheme is to utilize the varying performance of the (ICP) filter so that accurate filter quantization is only performed for those frames where more bits results in a noticeably better performance.

Figure 17:
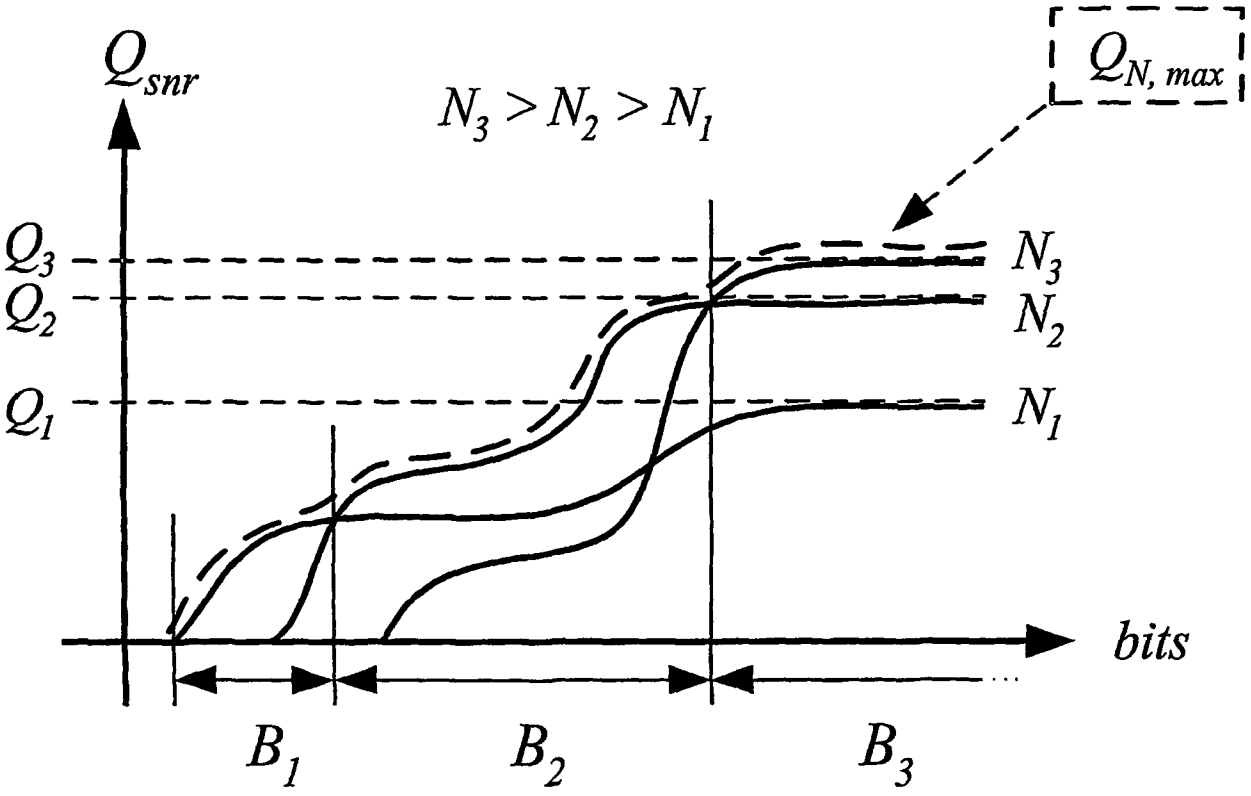
FIG. 17 illustrates the total quality achieved when quantizing different dimensions with different number of bits.

FIG. 17 illustrates the total quality achieved when quantizing different dimensions with different number of bits. For example, the objective may be defined such that maximum quality is achieved when selecting the combination of dimension and bit-rate that gives the minimum MSE. Remembering that MSE of the quantized ICP filter is defined as:

$$\mathrm{MSE}(\hat{h}^{(n)},n)=s^T s-(r^{(n)})^T h_{opt}^{(n)}+(e^{(n)})^T R^{(n)} e^{(n)} \tag{21}$$

It can be seen that the performance is a trade-off between the selected filter dimension n and the imposed quantization error. This is illustrated in FIG. 17 where different bit rate ranges give different performance for different dimensions.

Allocating the necessary bits for the (ICP) filter is efficiently performed based on the $Q_{N,max}$ curve. This optimal performance/rate curve $Q_{N,max}$ shows the optimum performance obtained by varying the filter dimension and the required amount of bits accordingly. It is also interesting to notice that this curve exhibits regions where the increase in bit rate (and the associated dimension) leads to a very small improvement in the performance/quality measure $Q_{snr}$. Typically, for these plateau regions, there is no noticeable gain achieved by increasing the amount of bits for the quantization of the (ICP) filter.

A simpler but suboptimal approach consists in varying the total amount of bits in proportion to the dimension, for instance to make the ratio between the total number of bits and dimension constant. The variable-rate/variable-dimension coding then involves selecting the dimension (or equivalently the bit-rate), which leads to the minimization of the MSE.

Figure 18:
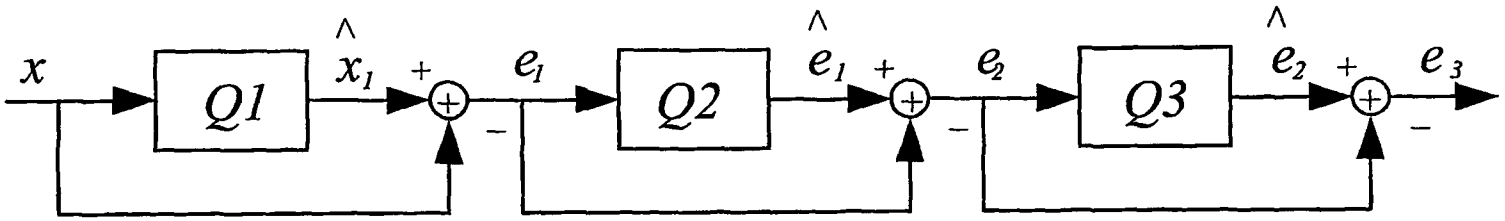
FIG. 18 is a schematic diagram illustrating an example of multi-stage vector encoding.

In another embodiment, the dimension is held fixed and the bit-rate is varied. A set of thresholds determine whether or not it is feasible to spend more bits on quantizing the filter, by e.g. selecting additional stages in a MSVQ [13] scheme depicted in FIG. 18.

Variable rate coding is well motivated by the varying characteristic of the correlation between the main (mono) and the side signal. For low correlation cases, only a few bits are allocated to encode a low dimensional filter while the rest of the bit budget could be used for encoding the residual error with a non-parametric coder.

Improved Parametric Coding Based on Inter-Channel Prediction

As mentioned briefly, for cases where main/side correlations is close to zero, it may be better not to use any ICP filtering at all, and instead allocate the whole bit budget to the secondary quantizer. For the same type of signals, if the performance of the secondary quantizer is insufficient, the signal may be coded using pure parametric ICP filtering. In the latter case, it may be advantageous to make some modifications to the ICP filtering procedure to provide acceptable stereo or multi-channel reconstruction.

These modifications are intended in order to operate stereo or multi-channel coding based solely on inter-channel prediction (ICP), thus allowing low bit-rate operation. In fact, a scheme where the side signal reconstruction is based solely on ICP filtering will normally suffer from quality degradation when the correlation between mono and side signal is weak. This holds especially true after quantization of the filter coefficients.

Covariance Matrix Modification

If only a parametric representation is used, then the target is no longer minimizing the MSE alone but to combine it with smoothing and regularization in order to be able to cope with the cases where there is no correlation between the mono and the side signal.

Informal listening test reveal that coding artifacts introduced by ICP filtering are perceived as more annoying than temporary reduction in stereo width. Therefore, the stereo width, i.e. the side signal energy, is intentionally reduced whenever a problematic frame is encountered. In the worst-case scenario, i.e. no ICP filtering at all, the resulting stereo signal is reduced to pure mono.

It is possible to calculate the expected prediction gain from the covariance matrix R and the correlation vector r, without having to perform the actual filtering. It has been found that coding artifacts are mainly present in the reconstructed side signal when the anticipated prediction gain is low or equivalently when the correlation between the mono and the side signal is low. Hence, a frame classification algorithm has been constructed, which performs classification based on estimated level of prediction gain. When the prediction gain (or the correlation) falls below a certain threshold, the covariance matrix used to derive the ICP filter is modified according to:

$$R^*=R+\rho\,\mathrm{diag}(R) \tag{22}$$

The value of ρ can be made adaptive to facilitate different levels of modification. The modified ICP filter is computed as $h^*=(R^*)^{-1}r$. Evidently, the energy of the ICP filter is reduced thus reducing the energy of the reconstructed side signal. Other schemes for reducing the introduced estimation errors are also plausible.

Filter Smoothing

Rapid changes in the ICP filter characteristics between consecutive frames create disturbing aliasing artifacts and instability in the reconstructed stereo image. This comes from the fact that the predictive approach introduces large spectral variations as opposed to a fixed filtering scheme.

Similar effects are also present in BCC when spectral components of neighboring sub-bands are modified differently [5]. To circumvent this problem, BCC uses overlapping windows in both analysis and synthesis.

The use of overlapping windows solves the alising problem for ICP filtering as well. However, this comes at the expense of a rather large reduction in MSE since the filter coefficients no longer are optimal for the present frame. A modified cost function is suggested. It is defined as:

$$\begin{aligned}\xi(h_t, h_{t-1}) &= MSE(h_t) + \psi(h_t, h_{t-1}) \\ &= MSE(h_t) + \mu(h_t - h_{t-1})^T R(h_t - h_{t-1})\end{aligned} \tag{23}$$

where $h_t$ and $h_{t-1}$ are the ICP filters at frame t and (t−1) respectively. Calculating the partial derivative of (23) and setting it to zero yields the new smoothed ICP filter:

$$h_t^*(\mu) = \frac{1}{1+\mu}h_t + \frac{\mu}{1+\mu}h_{t-1} \tag{24}$$

The smoothing factor μ determines the contribution of the previous ICP filter, thereby controlling the level of smoothing. The proposed filter smoothing effectively removes coding artifacts and stabilizes the stereo image. However this comes at the expense of a reduced stereo image.

The problem of stereo image width reduction due to smoothing can be overcome by making the smoothing factor adaptive. A large smoothing factor is used when the prediction gain of the previous filter applied to the current frame is high. However, if the previous filter leads to deterioration in the prediction gain, then the smoothing factor is gradually decreased.

Frequency Band Processing

The previously suggested algorithms benefit from frequency band processing. In fact, spatial psychoacoustics teaches that the dominant cues for sound localization in the lower frequencies are inter-channel time differences [6], while at high frequencies it is the inter-channel level differences. This suggests that the stereo or multi-channel reconstruction can benefit from coding different regions of the spectrum using different methods and different bit-rates. For example, hybrid parametric and non-parametric coding with adaptively controlled bit allocation could be performed in the low-frequency range, whereas some other coding scheme(s) could be used in higher frequency regions.

Variable-Length Optimized Frame Processing

For variable frame lengths, an encoding frame can generally be divided into a number of sub-frames according to various frame division configurations. The sub-frames may have different sizes, but the sum of the lengths of the sub-frames of any given frame division configuration is normally equal to the length of the overall encoding frame. As described in our co-pending U.S. patent application Ser. No. 11/011,765, which is incorporated herein as an example by this reference, and the corresponding International Application PCT/SE2004/001867, a number of encoding schemes is provided, where each encoding scheme is characterized by or associated with a respective set of sub-frames together constituting an overall encoding frame (also referred to as a master frame). A particular encoding scheme is selected, preferably at least to a part dependent on the signal content of the signal to be encoded, and then the signal is encoded in each of the sub-frames of the selected set of sub-frames separately.

In general, encoding is typically performed in one frame at a time, and each frame normally comprises audio samples within a pre-defined time period. The division of the samples into frames will in any case introduce some discontinuities at the frame borders. Shifting sounds will give shifting encoding parameters, changing basically at each frame border. This will give rise to perceptible errors. One way to compensate somewhat for this is to base the encoding, not only on the samples that are to be encoded, but also on samples in the absolute vicinity of the frame. In such a way, there will be a softer transfer between the different frames. As an alternative, or complement, interpolation techniques are sometimes also utilised for reducing perception artefacts caused by frame borders. However, all such procedures require large additional computational resources, and for certain specific encoding techniques, it might also be difficult to provide in with any resources.

In this view, it is beneficial to utilise as long frames as possible, since the number of frame borders will be small. Also the coding efficiency typically becomes high and the necessary transmission bit-rate will typically be minimised. However, long frames give problems with pre-echo artefacts and ghost-like sounds.

By instead utilising shorter frames, anyone skilled in the art realises that the coding efficiency may be decreased, the transmission bit-rate may have to be higher and the problems with frame border artefacts will increase. However, shorter frames suffer less from e.g. other perception artefacts, such as ghost-like sounds and pre-echoing. In order to be able to minimise the coding error as much as possible, one should use an as short frame length as possible.

Thus, there seems to be conflicting requirements on the length of the frames. Therefore, it is beneficial for the audio perception to use a frame length that is dependent on the present signal content of the signal to be encoded. Since the influence of different frame lengths on the audio perception will differ depending on the nature of the sound to be encoded, an improvement can be obtained by letting the nature of the signal itself affect the frame length that is used. In particular, this procedure has turned out to be advantageous for side signal encoding.

Due to small temporal variations, it may e.g. in some cases be beneficial to encode the side signal with use of relatively long frames. This may be the case with recordings with a great amount of diffuse sound field such as concert recordings. In other cases, such as stereo speech conversation, short frames are preferable.

For example, the lengths of the sub-frames used could be selected according to:

$$l_{sf}=l_f/2^n,$$

where $l_{sf}$ are the lengths of the sub-frames, $l_f$ is the length of the overall encoding frame and n is an integer. However, it should be understood that this is merely an example. Any frame lengths will be possible to use as long as the total length of the set of sub-frames is kept constant.

The decision on which frame length to use can typically be performed in two basic ways: closed loop decision or open loop decision.

When a closed loop decision is used, the input signal is typically encoded by all available encoding schemes. Preferably, all possible combinations of frame lengths are tested and the encoding scheme with an associated set of sub-frames that gives the best objective quality, e.g. signal-to-noise ratio or a weighted signal-to-noise ratio, is selected.

Alternatively, the frame length decision is an open loop decision, based on the statistics of the signal. In other words, the spectral characteristics of the (side) signal will be used as a base for deciding which encoding scheme that is going to be used. As before, different encoding schemes characterised by different sets of sub-frames are available. However, in this embodiment, the input (side) signal is first analyzed and then a suitable encoding scheme is selected and utilized.

The advantage with an open loop decision is that only one actual encoding has to be performed. The disadvantage is, however, that the analysis of the signal characteristics may be very complicated indeed and it may be difficult to predict possible behaviours in advance. A lot of statistical analysis of sound has to be performed. Any small change in the encoding schemes may turn upside down on the statistical behaviour.

By using closed loop selection, encoding schemes may be exchanged without making any changes in the rest of the implementation. On the other hand, if many encoding schemes are to be investigated, the computational requirements will be high.

The benefit with such a variable frame length coding for the input (side) signal is that one can select between a fine temporal resolution and coarse frequency resolution on one side and coarse temporal resolution and fine frequency resolution on the other. The above embodiments will preserve the multi-channel or stereo image in the best possible manner.

There are also some requirements on the actual encoding utilised in the different encoding schemes. In particular when the closed loop selection is used, the computational resources to perform a number of more or less simultaneous encoding have to be large. The more complicated the encoding process is, the more computational power is needed. Furthermore, a low bit rate at transmission is also to prefer.

The Variable Length Optimized Frame Processing according to an exemplary embodiment of the technology disclosed herein takes as input a large "master-frame" and given a certain number of frame division configurations, selects the best frame division configuration with respect to a given distortion measure, e.g. MSE or weighted MSE.

Frame divisions may have different sizes but the sum of all frames divisions cover the whole length of the master-frame.

Figure 19:
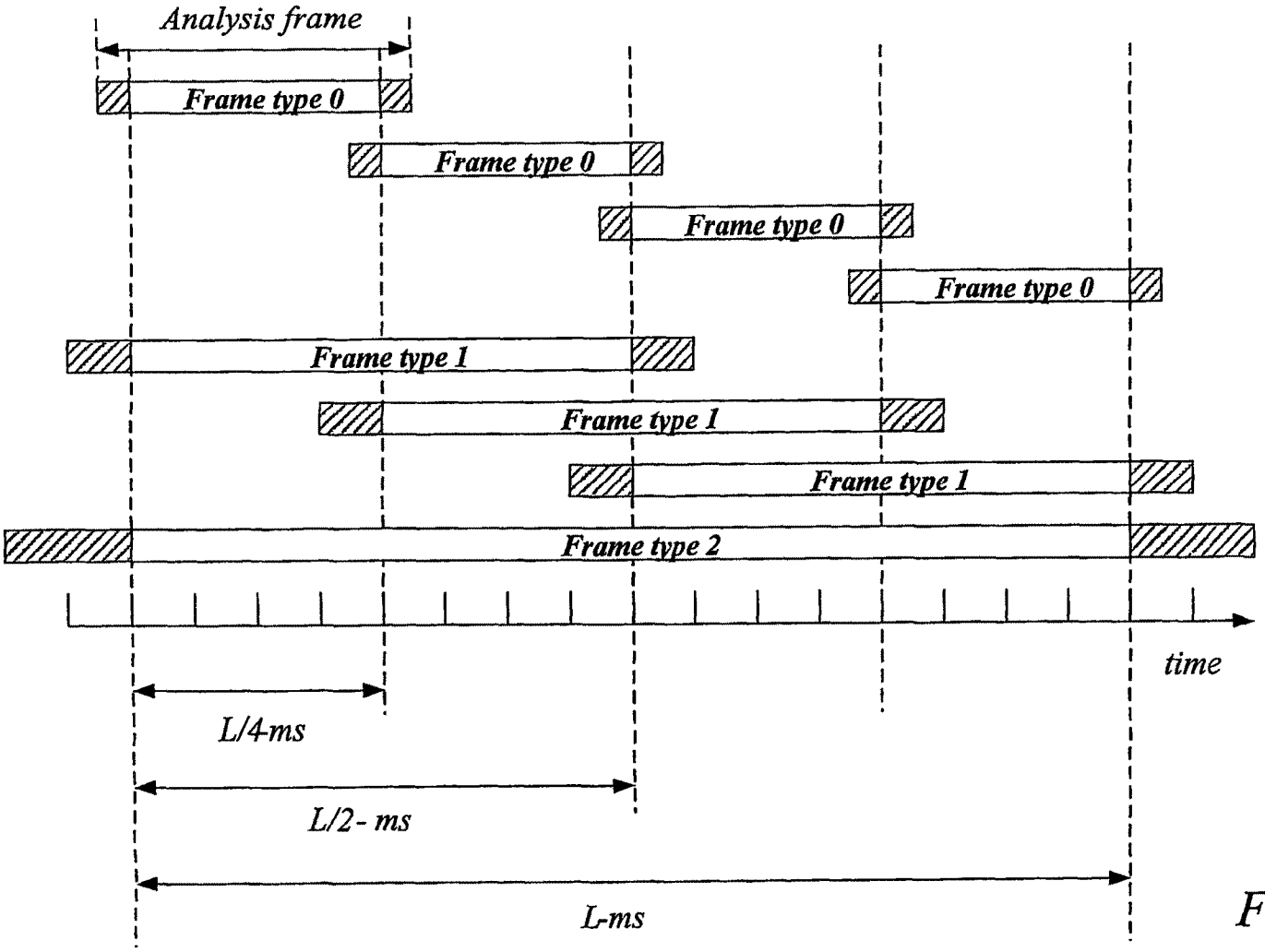
FIG. 19 is a schematic timing chart of different frame divisions in a master frame.
Figure 20:
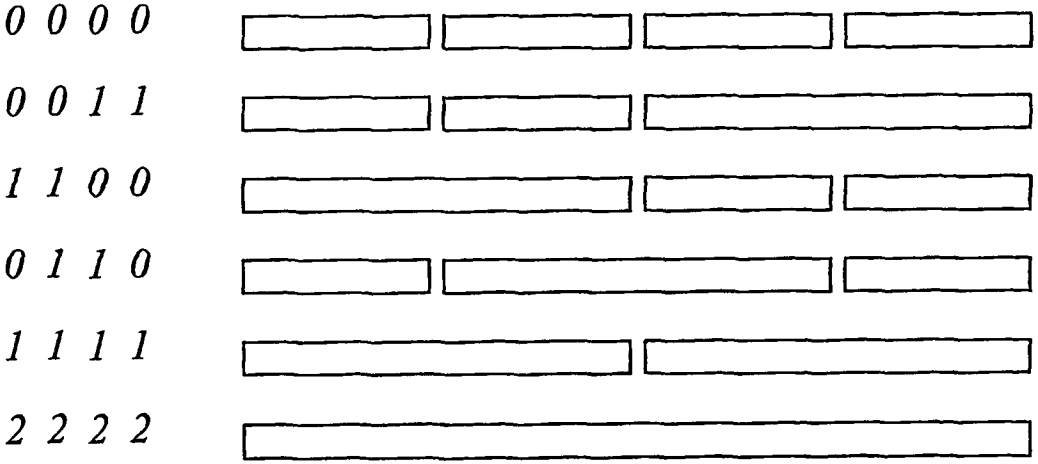
FIG. 20 illustrates different frame configurations according to an exemplary embodiment of the technology disclosed herein.

In order to illustrate an exemplary procedure, consider a master-frame of length L ms and the possible frame divisions illustrated in FIG. 19, and exemplary frame configurations are illustrated in FIG. 20.

In a particular exemplary embodiment of the technology disclosed herein, the idea is to select a combination of encoding scheme with associated frame division configuration, as well filter length/dimension for each sub-frame, so as to optimize a measure representative of the performance of the considered encoding process or signal encoding stage(s) thereof over an entire encoding frame (master-frame). The possibility to adjust the filter length for each sub-frame provides an added degree of freedom, and generally results in improved performance.

However, to reduce the signalling requirements during transmission from the encoding side to the decoding side, each sub-frame of a certain length is preferably associated with a predefined filter length. Usually long filters are assigned to long frames and short filters to short frames.

Possible frame configurations are listed in the following table:

| |
|---|
| 0, 0, 0, 0 |
| 0, 0, 1, 1 |
| 1, 1, 0, 0 |
| 0, 1, 1, 0 |
| 1, 1, 1, 1 |
| 2, 2, 2, 2 |

in the form ($m_1$, $m_2$, $m_3$, $m_4$) where $m_k$ denotes the frame type selected for the kth (sub)frame of length L/4 ms inside the master-frame such that for example $m_k$=0 for L/4 frame with filter length P, $m_k$=1 for L/2-ms frame with filter length 2×P, $m_k$=2 for L-ms super-frame with filter length 4×P.

For example, the configuration (0, 0, 1, 1) indicates that the L-ms master-frame is divided into two L/4-ms (sub) frames with filter length P, followed by an L/2-ms (sub) frame with filter length 2×P. Similarly, the configuration (2, 2, 2, 2) indicates that the L-ms frame is used with filter length 4×P. This means that frame division configuration as well as filter length information are simultaneously indicated by the information ($m_1$, $m_2$, $m_3$, $m_4$).

The optimal configuration is selected, for example, based on the MSE or equivalently maximum SNR. For instance, if the configuration (0,0,1,1) is used, then the total number of filters is 3:2 filters of length P and 1 of length 2×P.

The frame configuration, with its corresponding filters and their respective lengths, that leads to the best performance (measured by SNR or MSE) is usually selected.

The filters computation, prior to frame selection, may be either open-loop or closed-loop by including the filters quantization stages.

The advantage of using this scheme is that with this procedure, the dynamics of the stereo or multi-channel image are well represented. The transmitted parameters are the frame configuration as well as the encoded filters.

Because of the variable frame length processing that is involved, the analysis windows overlap in the encoder can be of different lengths. In the decoder, it is therefore essential for the synthesis of the channel signals to window accordingly and to overlap-add different signal lengths.

It is often the case that for stationary signals the stereo image is quite stable and the estimated channel filters are quite stationary. In this case, one would benefit from an FIR filter with longer impulse response, i.e. better modeling of the stereo image.

It has turned out to be particularly beneficial to add yet another degree of freedom by also incorporating the previously described bit allocation procedure into the variable frame length and adjustable filter length processing. In a preferred exemplary embodiment of the technology disclosed herein, the idea is to select a combination of frame division configuration, as well as bit allocation and filter length/dimension for each sub-frame, so as to optimize a measure representative of the performance of the considered encoding process or signal encoding stage(s) over an entire encoding frame. The considered signal representation is then encoded separately for each of the sub-frames of the selected frame division configuration in accordance with the selected bit allocation and filter dimension.

Preferably, the considered signal is a side signal and the encoder is a multi-stage encoder comprising a parametric (ICP) stage and an auxiliary stage such as a non-parametric stage. The bit allocation information controls how many quantization bits that should go to the parametric stage and to the auxiliary stage, and the filter length information preferably relates to the length of the parametric (ICP) filter.

The signal encoding process here preferably generates output data, for transfer to the decoding side, representative of the selected frame division configuration, and for each sub-frame of the selected frame division configuration, bit allocation and filter length.

With a higher degree of freedom, it is possible to find a truly optimal selection. However, the amount of control information to be transferred to the decoding side increases. In order to reduce the bit-rate requirements on signaling from the encoding side to the decoding side in an audio transmission system, the filter length, for each sub frame, is preferably selected in dependence on the length of the sub-frame, as described above. This means that an indication of frame division configuration of an encoding frame or master frame into a set of sub-frames at the same time provides an indication of selected filter dimension for each sub-frame, thereby reducing the required signaling.

The embodiments described above are merely given as examples, and it should be understood that the present technology disclosed herein is not limited thereto. Further modifications, changes and improvements which retain the basic underlying principles disclosed and claimed herein are within the scope of the technology disclosed herein.

REFERENCES

[1] U.S. Pat. No. 5,285,498 by Johnston.

[2] European Patent No. 0,497,413 by Veldhuis et al.

[3] C. Faller et al., "Binaural cue coding applied to stereo and multi-channel audio compression", 112th *AES convention*, May 2002, Munich, Germany.

[4] U.S. Pat. No. 5,434,948 by Holt et al.

[5] C. Faller and F. Baumgarte, "Binaural cue coding—Part I: Psychoacoustic fundamentals and design principles", *IEEE Trans. Speech Audio Processing*, vol. 11, pp. 509-519, November 2003.

[6] J. Robert Stuart, "The psychoacoustics of multichannel audio", Meridian Audio Ltd, June 1998

[7] S-S. Kuo, J. D. Johnston, "A study why cross channel prediction is not applicable to perceptual audio coding", *IEEE Signal Processing Lett.*, vol. 8, pp. 245-247.

[8] Y. Linde, A. Buzo and R. M. Gray, "An algorithm for vector quantizer design", *IEEE Trans. on Commun.*, vol. COM-28, pp. 84-95, January 1980.

[9] B. Edler, C. Faller and G. Schuller, "Perceptual audio coding using a time-varying linear pre- and post-filter", in *AES Convention*, Los Angeles, Calif., September 2000.

[10] Bernd Edler and Gerald Schuller, "Audio coding using a psychoacoustical pre- and post-filter", *ICASSP*-2000 *Conference Record,* 2000.

[11] Dieter Bauer and Dieter Seitzer, "Statistical properties of high-quality stereo signals in the time domain", *IEEE International Conf. on Acoustics, Speech, and Signal Processing*, vol. 3, pp. 2045-2048, May 1989.

[12] Gene H. Golub and Charles F. van Loan, "*Matrix Computations*", second edition, chapter 4, pages 137-138, The John Hopkins University Press, 1989.

[13] B-H. Juag and A. H. Gray Jr, "Multiple stage vector quantization for speech coding", In *International Conference on Acoustics, Speech, and Signal Processing*, vol. 1, pp. 597-600, Paris, April 1982.

The invention claimed is:

1. A decoding method to decode an encoded multi-channel audio signal, the decoding method comprising:

receiving first signal reconstruction data;

a first decoder decoding, in response to first signal reconstruction data, an encoded first signal representation of at least one channel of said multi-channel audio signal in a first signal decoding process;

a second decoder decoding, in response to second signal reconstruction data, an encoded second signal representation of at least one channel of said multi-channel audio signal in a second signal decoding process, the second signal decoding process being a multi-stage decoding process comprising first and second decoding stages;

a controller receiving bit allocation information representative of how a number of bits have been allocated among a parametric encoding stage and a non-parametric encoding stage in a second multistage hybrid parametric and non-parametric signal encoding process corresponding to the second signal decoding process; and the controller determining, based on said bit allocation information, how to interpret said second signal reconstruction data in said multi-stage signal decoding process including interpreting which bits of the second signal reconstruction data are allocated to the parametric encoding stage and which bits are allocated to the non-parametric encoding stage;

wherein the first and second decoding stages of the multi-stage decoding processes are such that the first decoding stage receives at least one output generated from the second decoding stage, wherein determining, based on the bit allocation information, how to interpret the second signal reconstruction data comprises determining a second signal prediction portion of the second signal reconstruction data allocated to carry an encoded second signal prediction, the second signal prediction being a prediction of the second signal representation, and determining a second signal prediction error portion of the second signal reconstruction data allocated to carry an encoded second signal prediction error, the second signal prediction error being an estimated error of the second signal prediction, wherein the second decoding stage comprises decoding the second signal prediction error portion to determine the second signal prediction error, and wherein the first decoding stage comprises decoding the second signal prediction portion;

determining the second signal representation based on the decoded second signal prediction portion and based on the first signal representation decoded by the first decoder; and applying the second signal prediction error received from the second decoding stage to the determined second signal representation.

2. A decoding apparatus configured to decode an encoded multi-channel audio signal, the decoding apparatus comprising:

a receiver configured to receive first signal reconstruction data;

a first decoder configured to decode, in response to first signal reconstruction data, an encoded first signal representation of at least one channel of said multi-channel audio signal;

a second decoder configured to decode, in response to second signal reconstruction data, an encoded second signal representation of at least one of said multiple channels, the second decoder being a multi-stage decoder comprising second and first decoding stages; and a controller configured to receive bit allocation information representative of how a number of bits have been allocated among a parametric encoding stage and a non-parametric encoding stage in a multi-stage hybrid parametric and non-parametric encoder corresponding to the second decoder, and determine, based on said bit allocation information, how to interpret said second signal reconstruction data in said second decoder for the purpose of decoding the second signal representation including interpreting which bits of the second signal reconstruction data are allocated to the parametric encoding stage and which bits are allocated to the non-parametric encoding stage;

wherein the first and second decoding stages of the multi-stage decoder are in series such that the first decoding stage receives at least one output from the second decoding stage, wherein the controller is configured determine, based on the bit allocation information, a second signal prediction portion of the second signal reconstruction data allocated to carry an encoded second signal prediction, the second signal prediction being a prediction of the second signal representation, and a second signal prediction error portion of the second signal reconstruction data allocated to carry an encoded second signal prediction error, the second signal prediction error being an estimated error of the second signal prediction, wherein the second decoding stage is configured to decode the second signal prediction error portion to determine the second signal prediction error, and wherein the first decoding stage is configured to decode the second signal prediction portion, determine the second signal representation based on the decoded second signal prediction portion and based on the first signal representation decoded by the first decoder, and apply the second signal prediction error received from the second decoding stage to the determined second signal representation.

3. An audio transmission system, characterized in that said system comprises a decoding apparatus of claim 2.

4. An encoding method to encode a multi-channel audio signal, the encoding method comprising:

receive the multi-channel audio signal over input channels;

a first encoder encoding a first signal representation of at least one channel of said multi-channel audio signal in a first signal encoding process;

a second encoder encoding a second signal representation of at least one channel of said multi-channel audio signal in a second signal encoding process, said second signal encoding process being a multi-stage encoding process comprising first and second encoding stages; and a controller adaptively allocating a number of encoding bits among the first and second encoding stages of the multi-stage signal encoding process based on inter-channel correlation characteristics of the multi-channel audio signal, wherein said adaptively allocating the number of encoding bits among the first and second encoding stages is performed based on an estimated performance of the first and/or the second encoding stage;

wherein said first and second encoding stages of the multi-stage signal encoding process comprise a hybrid parametric and non-parametric encoding stages, and wherein the encoding bits are allocated between the parametric encoding stage and the non-parametric encoding stage based on the inter-channel correlation characteristics;

wherein said adaptively allocating the number of encoding bits comprises allocating more bits to the non-parametric encoding stage when a performance of the parametric encoding stage is saturating.

5. The encoding method of claim 4, wherein said adaptively allocating the number of bits among the first and second encoding stages is performed on a frame-by-frame basis.

6. The encoding method of claim 4, wherein said multi-stage signal encoding process includes an adaptive inter-channel prediction in the first encoding stage for a prediction of said second signal representation based on the first signal representation and the second signal representation, and wherein said performance is estimated at least partly based on a signal prediction error, the signal prediction error being an estimated error of the prediction of the second signal representation.

7. The encoding method of claim 6, wherein said performance is estimated also based on an estimation of a quantization error as a function of the number of bits allocated for quantization of second-signal reconstruction data generated by said adaptive inter-channel prediction.

8. The encoding method of claim 6, wherein said multi-stage signal encoding process includes an encoding process in the second encoding stage for encoding a representation of the signal prediction error received from said first encoding stage.

9. The encoding method of claim 4, wherein the adaptively allocating the number of encoding bits comprises allocating the number of bits among the first and second encoding stages based on the estimated performance of the first and/or the second encoding stage in relation to the second signal representation currently being encoded through the second signal encoding process.

10. The encoding method of claim 4, wherein said number of encoding bits is determined by a bit budget for said multi-stage signal encoding process, the method further comprising generating output data representative of the bit allocation.

11. The encoding method of claim 4, further comprising selecting a combination bit allocation and filter length for encoding so as to optimize a measure representative of the performance of said second signal encoding process.

12. The encoding method of claim 11, further comprising selecting the combination bit allocation and filter length for encoding each frame so as to minimize a Mean Squared Error (MSE) of a prediction error over an entire encoding frame.

13. The encoding method of claim 11, further comprising generating output data representative of the selected bit allocation and filter length.

14. The encoding method of claim 4, further comprising:

selecting combination of frame division configuration of an encoding frame into a set of sub-frames, and bit allocation and filter length for encoding for each sub-frame, so as to optimize a measure representative of the performance of said second signal encoding process over an entire encoding frame; and encoding said second signal representation in each of the sub-frames of the selected set of sub-frames separately in accordance with the selected combination.

15. The encoding method of claim 14, further comprising generating output data representative of the selected frame division configuration, and for each sub-frame of the selected frame division configuration, bit allocation and filter length.

16. The encoding method of claim 15, further comprising selecting the filter length, for each sub frame, based on the length of the sub-frame so that an indication of frame division configuration of an encoding frame into a set of sub-frames at the same time provides an indication of selected filter dimension for each sub-frame to thereby reduce the required signaling.

17. The encoding method of claim 4, further comprising selecting a combination of number of bits to be allocated to said first encoding stage and filter length to be used in said first encoding stage so as to optimize a measure representative of the performance of at least said first encoding stage.

18. An encoding apparatus configured to encode a multi-channel audio signal, the decoding apparatus comprising:

input channels configured to receive the multi-channel audio signal;

a first encoder configured to encode a first signal representation of at least one channel of said multi-channel audio signal;

a second encoder configured to encode a second signal representation of at least one channel of said multi-channel audio signal, the second encoder being a multi-stage encoder comprising first and second encoding stages; and a controller configured to adaptively allocate a number of encoding bits among the first and second encoding stages of the second encoder based on inter-channel correlation characteristics of the multi-channel audio signal, wherein the controller is configured to adaptively allocate the number of encoding bits among the first and second encoding stages based on an estimated performance of the first and/or the second encoding stage; wherein said first and second encoding stages comprise hybrid parametric and non-parametric encoding stages, and wherein said controller is configured to allocate the encoding bits between the parametric encoding stage and the non-parametric encoding stage based on the inter-channel correlation characteristics;

wherein said controller is configured to allocate more bits to the non-parametric encoding stage when a performance of the parametric encoding stage is saturating.

19. The encoding apparatus of claim 18, wherein the controller is configured to adaptively allocate the number of bits among the first and second stages based on the estimated performance of the first and/or the second encoding stage in relation to the second signal representation currently being encoded by the second encoder.

20. The encoding apparatus of claim 18, wherein said number of encoding bits are determined by a bit budget for said second encoder, and wherein said second encoder is configured to generate output data representative of the bit allocation.

21. The encoding apparatus of claim 18, wherein controller is configured to adaptively allocate the number of bits among the first and second encoding stages on a frame-by-frame basis.

22. An audio transmission system, characterized in that said system comprises an encoding apparatus of claim 18.

23. The apparatus of claim 18, wherein the controller is configured to select the combination bit allocation and filter length for encoding so as to minimize a Mean Squared Error (MSE) of a prediction error over an entire encoding frame.

24. The encoding apparatus of claim 18, wherein the first encoding stage includes an adaptive inter-channel prediction filter for a second-signal prediction based on the first signal representation and the second signal representation, and wherein said controller is configured to estimate the performance of at least said first encoding stage at least partly based on a signal prediction error, the signal prediction error being an estimated error of the second signal prediction.

25. The encoding apparatus of claim 24, wherein said controller is configured to assess the estimated performance of at least said first encoding stage based on assessment of an estimated quantization error as a function of the number of bits allocated for quantization of said adaptive inter-channel prediction filter.

26. The encoding apparatus of claim 24, wherein said second encoding stage is configured to encode a representation of the signal prediction error received from said first encoding stage.

27. The encoding apparatus of claim 18, wherein said controller is configured to assess an estimated performance of the first encoding stage of said second encoder as a function of a first number of encoding bits assumed to be allocated to said first encoding stage, and allocate said first number of encoding bits to said first encoding stage based on said assessment.

28. The encoding apparatus of claim 27, wherein the controller is configured to select a combination of i) frame division configuration of an encoding frame into a set of sub-frames, ii) number of bits to be allocated to said first encoding stage for each sub-frame, and iii) filter length to be used in said first encoding stage for each sub-frame, so as to optimize a measure representative of the performance of at least said first encoding stage over an entire encoding frame, and wherein the second encoder is configured to encode said second signal representation in each of the sub-frames of the selected set of sub-frames separately in accordance with the selected combination.

29. The encoding apparatus of claim 27, wherein the controller is configured to select a combination of number of bits to be allocated to said first encoding stage and filter length to be used in said first encoding stage so as to optimize a measure representative of the performance of at least said first encoding stage.

30. The encoding apparatus of claim 18, wherein the controller is configured to select a combination bit allocation and filter length for encoding so as to optimize a measure representative of the performance of said second encoder.

31. The encoding apparatus of claim 30, wherein said second encoder is configured to generate output data representative of the selected bit allocation and the filter length.

32. The encoding apparatus of claim 18, wherein the controller is configured to select a combination of frame division configuration of an encoding frame into a set of sub-frames, and bit allocation and filter length for encoding for each sub-frame, so as to optimize a measure representative of the performance of said second encoder over an entire encoding frame and wherein the second encoder is configured to encode said second signal representation in each of the sub-frames of the selected set of sub-frames separately in accordance with the selected combination.

33. The encoding apparatus of claim 32, wherein said second encoder is configured to generate output data representative of the selected frame division configuration, and for each sub-frame of the selected frame division configuration, bit allocation and filter length.

34. The encoding apparatus of claim 33, wherein said second encoder is configured to select the filter length, for each sub frame, based on the length of the sub-frame so that an indication of frame division configuration of an encoding frame into a set of sub-frames at the same time provides an indication of selected filter dimension for each sub-frame to thereby reduce the required signaling.

35. An encoding apparatus configured to encode a multi-channel audio signal, the decoding apparatus comprising:

input channels configured to receive the multi-channel audio signal;

a first encoder configured to encode a first signal representation of at least one channel of said multi-channel audio signal;

a second encoder configured to encode a second signal representation of at least one channel of said multi-channel audio signal, the second encoder being a multi-stage encoder comprising first and second encoding stages; and a controller configured to adaptively allocate a number of encoding bits among the first and second encoding stages of the second encoder based on inter-channel correlation characteristics of the multi-channel audio signal, wherein the controller is configured to adaptively allocate the number of encoding bits among the first and second encoding stages based on an estimated performance of the first and/or the second encoding stage; wherein said first and second encoding stages comprise hybrid parametric and non-parametric encoding stages, and wherein said controller is configured to allocate the encoding bits between the parametric encoding stage and the non-parametric encoding stage based on the inter-channel correlation characteristics;

wherein the parametric encoding stage comprises an inter-channel prediction (ICP) filter and an associated first quantizer for quantization of the ICP filter, and wherein the non-parametric encoding stage comprises a second quantizer for quantization of a residual prediction error of the ICP filter.

36. An encoding method to encode a multi-channel audio signal, the encoding method comprising:

receiving the multi-channel audio signal input channels;

a first encoder encoding a first signal representation of at least one channel of said multi-channel audio signal in a first signal encoding process;

a second encoder encoding a second signal representation of at least one channel of said multi-channel audio signal in a second signal encoding process, said second signal encoding process being a multi-stage encoding process comprising first and second encoding stages; and a controller adaptively allocating a number of encoding bits among the first and second encoding stages of the multi-stage signal encoding process based on inter-channel correlation characteristics of the multi-channel audio signal, wherein said adaptively allocating the number of encoding bits among the first and second encoding stages is performed based on an estimated performance of the first and/or the second encoding stage wherein the first and second encoding stages of the multi-stage encoding processes are such that the second encoding stage receives at least one output generated from the first encoding stage, wherein the first encoding stage comprises generating and quantizing a second signal prediction based on the first and second signal representations, the second signal prediction being a prediction of the section signal representation; and generating second signal prediction error based on the first and second signal representations, the second signal prediction error being an estimated error of the second signal prediction, wherein the second encoding stage comprises quantizing the second signal prediction error received from the first encoding stage, and wherein the number of encoding bits are adaptively allocated to encode the quantized second signal prediction and the quantized second signal prediction error, the encoding bits being transmitted to a multi-channel audio signal decoder.

37. An encoding apparatus configured to encode a multi-channel audio signal, the decoding apparatus comprising:

input channels configured to receive the multi-channel audio signal;

a first encoder configured to encode a first signal representation of at least one channel of said multi-channel audio signal;

a second encoder configured to encode a second signal representation of at least one channel of said multi-channel audio signal, the second encoder being a multi-stage encoder comprising first and second encoding stages; and a controller configured to adaptively allocate a number of encoding bits among the first and second encoding stages of the second encoder based on inter-channel correlation characteristics of the multi-channel audio signal, wherein the controller is configured to adaptively allocate the number of encoding bits among the first and second encoding stages based on an estimated performance of the first and/or the second encoding stage;

wherein the first and second encoding stages of the multi-stage encoder are in series such that the second encoding stage receives at least one output from the first encoding stage, wherein the first encoding stage is configured to generate and quantize a second signal prediction based on the first and second signal representations, the second signal prediction being a prediction of the section signal representation; and generating second signal prediction error based on the first and second signal representations, the second signal prediction error being an estimated error of the second signal prediction, wherein the second encoding stage is configured to quantize the second signal prediction error received from the first encoding stage, and wherein the controller is configured to adaptively allocate the number of encoding bits to encode the quantized second signal prediction and the quantized second signal prediction error, the encoding bits being transmitted to a multi-channel audio signal decoder.

38. An audio encoder configured to encode a multi-channel audio signal, the audio encoder comprising:

input channels configured to receive the multi-channel audio signal;

a main encoder configured to receive a main signal portion and to generate an encoded main signal frame based on the main signal portion, the main signal portion being a portion of a main representation of one or more channels of the multi-channel audio signal;

a side encoder configured to receive a side signal portion and to generate an encoded side signal frame based on the side signal portion, the side signal portion being a portion of a side representation of the one or more channels of the multi-channel audio signal; and a controller configured to allocate bits of the encoded side signal frame so as to encode the corresponding side signal portion, wherein the side encoder is a multi-stage encoder comprising:

a first stage encoder configured to generate and quantize an estimated side signal portion corresponding to the side signal portion, the estimated side signal portion representing an estimate of the corresponding side signal portion, the first stage encoder also being configured to generate a residual error portion representing an estimate of a difference between the side signal portion and the corresponding estimated side signal portion; and a second stage encoder configured to quantize the residual error portion received from the first stage encoder, wherein the encoded side signal frame includes the quantized estimated side signal portion and the quantized residual error portion, wherein the controller is configured to:

estimate a performance of the first stage encoder in relation to a current encoded side signal frame being generated by the side encoder, and allocate bits of the current encoded side signal frame between a current estimated side signal portion and a current residual error portion based on the estimated performance of the first stage encoder in relation to the current encoded side signal frame.

39. The audio encoder of claim 38, wherein the side encoder is also configured to receive the main signal portion and/or the corresponding encoded main signal frame, and wherein the first stage encoder is configured to generate one or both of the estimated side signal portion and the residual error portion also based on the main signal portion and/or the corresponding encoded main signal frame.

40. The audio encoder of claim 38, wherein the controller is configured to receive the main and side signal portions, determine one or more inter-channel correlation characteristics of the multi-channel audio signal based on the main and side signal portions, the inter-channel correlation characteristics including a cross correlation between the main and side signal portions, and estimate the performance of the first stage encoder performance of the first stage encoder in relation to the current encoded side signal frame based on the inter-channel correlation characteristics of the multi-channel audio signal.

41. The audio encoder of claim 38, wherein the first stage encoder is configured to generate inter-channel prediction (ICP) filter coefficients from filtering the main signal portion through a time varying finite impulse response (FIR) filter, the ICP filter coefficients representing the estimated side signal portion and being generated so as to minimize a side signal prediction error e(n) representing the residual error portion, and quantize the ICP filter coefficients, and wherein the second stage encoder is configured to quantize the side signal prediction error e(n).

42. The audio encoder of claim 38, wherein the controller is configured to allocate a relatively greater portion of the bits of the encoded side signal frame to the residual error portion as the performance of the first stage encoder saturates.

43. An encoding method to encode a multi-channel audio signal, the encoding method comprising:

receiving the multi-channel audio signal over input channels;

a first encoder encoding a first signal representation of at least one channel of said multi-channel audio signal in a first signal encoding process;

a second encoder encoding a second signal representation of at least one channel of said multi-channel audio signal in a second signal encoding process, said second signal encoding process being a multi-stage encoding process comprising first and second encoding stages; and a controller adaptively allocating a number of encoding bits among the first and second encoding stages of the multi-stage signal encoding process based on inter-channel correlation characteristics of the multi-channel audio signal, wherein said adaptively allocating the number of encoding bits among the first and second encoding stages is performed based on an estimated performance of the first and/or the second encoding stage;

wherein said first and second encoding stages of the multi-stage signal encoding process comprise a hybrid parametric and non-parametric encoding stages, and wherein the encoding bits are allocated between the parametric encoding stage and the non-parametric encoding stage based on the inter-channel correlation characteristics;

wherein the parametric encoding stage comprises an inter-channel prediction (ICP) filter and an associated first quantizer for quantization of the ICP filter, and wherein the non-parametric encoding stage comprises a second quantizer for quantization of a residual prediction error of the ICP filter.

* * * * *